US012496506B2

(12) United States Patent
Greene

(10) Patent No.: US 12,496,506 B2
(45) Date of Patent: Dec. 16, 2025

(54) PUTTING AID

(71) Applicant: YIPOCORP, INC., Charlotte, NC (US)

(72) Inventor: Phillip R. Greene, Charlotte, NC (US)

(73) Assignee: YIPOCORP, INC., Charlotte, NC (US)

( * ) Notice: Subject to any disclaimer, the term of this patent is extended or adjusted under 35 U.S.C. 154(b) by 316 days.

(21) Appl. No.: 18/136,840

(22) Filed: Apr. 19, 2023

(65) Prior Publication Data

US 2023/0330505 A1 Oct. 19, 2023

Related U.S. Application Data

(60) Provisional application No. 63/363,233, filed on Apr. 19, 2022.

(51) Int. Cl.
*A63B 69/36* (2006.01)

(52) U.S. Cl.
CPC ..... *A63B 69/3682* (2020.08)

(58) Field of Classification Search
CPC ..... A63B 69/3682; A63B 69/3621; A63B 69/3676; A63B 2071/0694
USPC ..... 473/219, 257, 261, 262, 264, 265, 266, 473/268, 269
See application file for complete search history.

(56) References Cited

U.S. PATENT DOCUMENTS 5,007,646 A * 4/1991 Baber ..... A63B 69/3676 473/268
5,211,400 A * 5/1993 Hall ..... A63B 69/3682 473/268
5,375,844 A * 12/1994 Waud ..... A63B 69/3629 473/268
6,416,420 B1 7/2002 Stark
7,455,596 B1 * 11/2008 Greene ..... A63B 69/3682 473/266
2017/0036093 A1 2/2017 Mazzaferri et al.
2022/0395739 A1 * 12/2022 Brittnell ..... A63B 69/3621

FOREIGN PATENT DOCUMENTS

WO 2010/053476 A1 5/2010

OTHER PUBLICATIONS

International Preliminary Report on Patentability issued in International Patent Application No. PCT/US2023/019165 on Oct. 8, 2024, 7 pages.
International Search Report issued in International Patent Application No. PCT/US2023/019165 on Jul. 20, 2023, 2 pages.
Written Opinion issued in International Patent Application No. PCT/US2023/019165 on Jul. 20, 2023, 6 pages.

* cited by examiner

*Primary Examiner* — Nini F Legesse
(74) *Attorney, Agent, or Firm* — Bradley Arant Boult Cummings LLP; Henry B. Ward, III

(57) ABSTRACT

An alignment device for golf to be used as a practice aid for aligning a dominant eye of a user, a putter and a golf ball with a target line to a hole on a putting green, comprising a base comprising at least one alignment indicia and at least one alignment extension extending from the base, wherein the at least one alignment indicia of the base and the at least one alignment extension are configured to align the dominant eye of the user, the putter and the golf ball with the target line to the hole on the putting green.

18 Claims, 22 Drawing Sheets

PUTTING AID

CROSS REFERENCE TO RELATED APPLICATIONS

This patent application claims priority to U.S. Provisional Patent Application No. 63/363,233, titled "Putting Aid", filed on Apr. 19, 2022, the contents of which are herein incorporated by reference in their entirety.

FIELD OF THE INVENTION

The invention relates to a setup and an alignment device for setting up a golfer and aligning a putter on a target line that traverses through an impact point of a golf ball resting on the target line of a putt. Utilizing this device, the golfer is able to correlate the perceived alignment of the ball with the actual direction of impact required to maximize the probability that the ball travels in the desired direction.

BACKGROUND OF THE INVENTION

The direction in which a golf ball rolls depends on a variety of factors, some of which include the relative "speed" of the green, the slope, the lie of the ground beneath the ball, and the way in which the golfer sets up, or "addresses," the ball. It is the combination of these factors that affect how the ball is struck and rolls. Even skilled golfers are challenged to consistently understand the impact on setup of correct eye alignment and subsequent delivery of force for putts on different types of slopes. Greens may have any type, or combination of types, of slopes that must be considered when addressing the ball, such as a straight flat lie, straight downhill lie, straight uphill lie, left to right uphill lie, left to right downhill lie, right to left uphill lie, right to left downhill lie, straight sidehill lie that ultimately breaks left, and straight sidehill lie that ultimately breaks right.

Aside from the environmental factors, there is a perceptual factor based on parallax between the position of the player's body and the ball that affects the ability of the golfer to translate what is perceived as the required direction of impact on the ball, into the direction of actual impact. If the body, particularly the head, eyes and shoulders, is not correctly aligned, the player will believe that the ball is being struck in the desired direction, when in fact the ball is being struck in an undesired direction.

A driving factor of the invention described in this application is that the more closely and consistently the golfer's dominant eye is positioned in a substantially bi-directionally perpendicular orientation over the slope directly under the ball, or at least at an angle in which a golfer can learn to recognize and repeatedly position his/her dominant eye regardless of the slope of the putting surface, the greater the probability that the golfer will 1) setup correctly, 2) consistently visualize the line correctly, 3) align the putter behind the ball on the target line correctly, and 4) deliver the force when striking the ball so that it will roll the desired direction and distance. The term "perpendicular" as used herein is intended to refer to the position of the eye line in relation to the slope under the ball as it lies on the putting surface, and the term "bi-directional" is intended to refer to the visual bisecting of a point adjacent the ball when the eye line is perpendicular to the putting surface. As the impact on the backside of the ball occurs, it is the target line of the putt as it intersects the backside of the ball that should be perpendicular with a line of sight of the dominant eye of the golfer.

The reasoning behind the above is twofold. First, when the dominant eye is bi-directionally perpendicular to the back of the ball as it rests on the target line of the putt, the parallax of improper positioning and unintended direction of the putter's force, i.e. inside, outside, in front of, behind or any possible combination, over the ball is reduced or eliminated. Secondly, the ability to swing the putter in a pendulum fashion back and through along the target line of the putt is optimized and, therefore, maximizes energy transfer more consistently from the putter to the back of the ball, resulting in more consistent distance and direction.

It is known that setup over the ball is an important factor in correctly transferring the intended force, which is a vector quantity, down the target line translating the intended direction of the ball into the actual direction. Of course, the official rules of play do not permit the use of alignment devices beyond what can be legally applied to the putter head itself, such as positioning lines, a representation of balls directly behind the putter face, and so forth. Thus, proper training should include a means by which a player can learn by repetition in practice the proper place of the dominant eye and weight distribution in relation to the ball, putter head, and the target line on any particular slope. Practice, trial-and-error correction, and further repetition of the corrected position have been shown to improve identifying the correct line and positioning of the putter on the target line behind the ball in a perpendicular position beneath the dominant eye. It should be understood that the term "perpendicular" as used herein does not imply only an exact 90-degree orientation with reference to the putting surface, and may include a position perceived by the player as being perpendicular, even though deviating from perpendicular. Therefore, the invention allows for a golfer to identify and master the preferred setup, even though it may vary slightly from the more technically correct positioning. The invention allows the golfer to reduce or eliminate parallax (which is an unknown consequence of improper setup) to the line, the ball and the putter face's orientation to the ball on the target line. Said a different way, proper setup positions the eye consistently over the target line, regardless of slope, enabling the golfer to make necessary adjustments to properly identify and correctly view the initial line of travel for every putt the same way. This translates into the golfer being able to view every putt in the exact same way, regardless of length, the number of times it breaks, or the slope that exists directly under the ball. After correctly setting up with the dominant eye in the correct position, the golfer is then able to optimize the putter face alignment to the target line by having reduced or eliminated parallax. Once the golfer is set up, and the putter face aligned correctly, the golfer's stroke will move the putter along the target line of travel to impact the ball and deliver the putter's force more consistently resulting in greater control of distance and direction.

This ability to properly position the putter on the target line behind the ball is then taken to the golf course during play, where the golfer studies the green conditions and slope to determine the appropriate force and direction of the putt, and then applying the perceptual factor to properly strike the ball, causing it to roll in the desired direction and distance.

It is desirable to develop an alignment device and a method which minimizes the effect from environmental factors, as well as parallax, on the setup of the golfer and alignment of a golf shot.

SUMMARY OF THE INVENTION

The following presents a simplified summary of one or more embodiments of the present invention, in order to provide a basic understanding of such embodiments. This summary is not an extensive overview of all contemplated embodiments and is intended to neither identify key or critical elements of all embodiments nor delineate the scope of any or all embodiments. Its sole purpose is to present some concepts of one or more embodiments of the present invention in a simplified form as a prelude to the more detailed description that is presented later.

Consistent and consonant with the present invention, an alignment device and method which minimizes the effect from environmental factors, as well as parallax, on the setup of the golfer and alignment of a golf shot has surprisingly been discovered.

In one aspect, an alignment device for golf to be used as a practice aid for aligning a dominant eye of a user, a putter and a golf ball with a hole on a putting green is presented. The alignment device may comprise a base comprising at least one alignment indicia; and at least one alignment extension extending from the base, wherein the at least one alignment indicia of the base and the at least one alignment extension are configured to align the dominant eye of the user, the putter and the golf ball with the target line to the hole on the putting green.

In some embodiments, the at least one alignment indicia on the base comprises at least one selected from the group consisting of a slot or line.

In some embodiments, the base comprises first and second ends and first and second lateral sides and comprises a first axis extending from the first end to the second end and a second axis extending from the first lateral side to the second lateral side at the midway point of the first axis, and wherein the base comprises a first part and a second part demarcated by the second axis, and wherein the at least one alignment indicia on the base comprises at least one selected from the group consisting of a slot or line located on the first part having a first end point and a second end point, wherein the distance from first end of the base to the first end point is shorter than the distance from the first end of the base to the second end point.

In some embodiments, the base comprises first and second ends and first and second lateral sides and comprises a first axis extending from the first end to the second end and a second axis extending from the first lateral side to the second lateral side at the midway point of the first axis, and wherein the base comprises a first part and a second part demarcated by the second axis, and wherein the at least one alignment indicia on the base comprises at least one selected from the group consisting of a slot or line located on the first part having a first end point and a second end point, wherein the distance from first end of the base to the first end point is the same as the distance from the first end of the base to the second end point.

In some embodiments, the base comprises a first lateral surface and a second lateral surface, wherein the base comprise first and second lateral sides and first and second ends extending between the first lateral surface and the second lateral surface, wherein the at least one alignment indicia of the base is located on the first lateral surface, wherein the second lateral surface of the base comprises a substantially planar surface and wherein the at least one alignment extension comprises a lateral alignment extension member extending from the base laterally in a plane that is the same as or is parallel to the planar surface defined by the second lateral surface of the base.

In some embodiments, the lateral alignment extension member comprises at least one alignment indicia.

In some embodiments, the at least one alignment indicia on the lateral alignment extension member comprises at least one selected from the group consisting of a slot or line.

In some embodiments, the lateral alignment extension comprises an aperture.

In some embodiments, the base comprises a first lateral surface and a second lateral surface, wherein the base comprises first and second lateral sides and first and second ends extending between the first lateral surface and the second lateral surface, wherein the at least one alignment indicia of the base is located on the first lateral surface, wherein the at least one alignment extension comprises at least one vertical alignment extension member extending from the first lateral surface of the base.

In some embodiments, the at least one vertical alignment extension member comprises a straight elongate member.

In some embodiments, the second lateral surface of the base comprises a substantially planar surface and wherein the at least one vertical alignment extension member comprises a support member extending from the first lateral surface of the base and a lateral alignment extension member extending from the support member laterally in a plane that is substantially parallel to the planar surface defined by the second lateral surface of the base.

In some embodiments, the support member is rotatably coupled to the first lateral surface of the base.

In some embodiments, the lateral alignment extension member is rotatably coupled to the support member.

In some embodiments, the support member is rotatably coupled to the first lateral surface of the base, wherein the lateral alignment extension member is rotatably coupled to the support member, and wherein the first lateral surface of the base defines a recess structured to receive the support member and the lateral alignment extension member in a stored state.

In some embodiments, the lateral alignment extension member comprises at least one alignment indicia.

In some embodiments, the at least one alignment indicia on the lateral alignment extension member comprises at least one selected from the group consisting of a slot or line.

BRIEF DESCRIPTION OF THE DRAWINGS

The above, as well as other objects and advantages of the invention, will become readily apparent to those skilled in the art from reading the following detailed description of an embodiment of the invention when considered in the light of the accompanying drawing which.

DETAILED DESCRIPTION OF THE INVENTION

Figure 1:
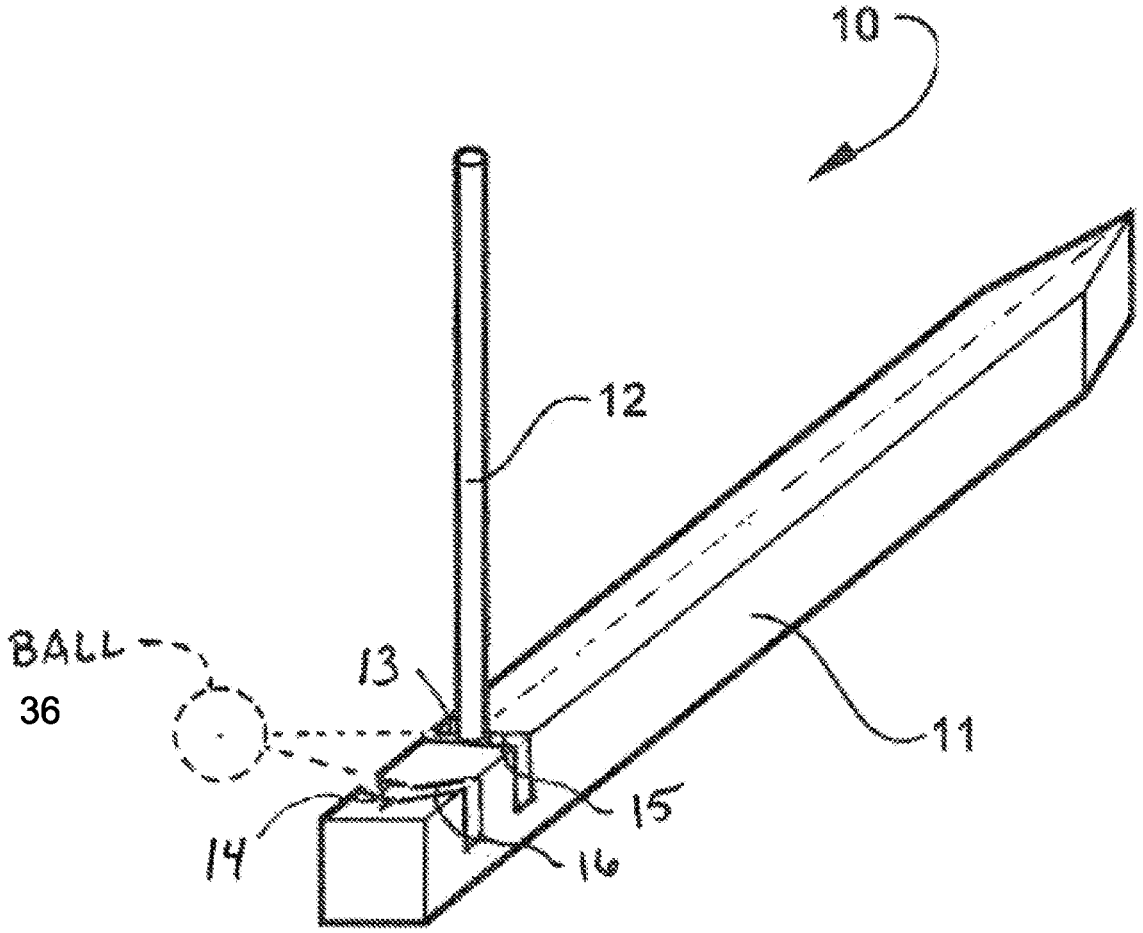
FIG. 1 is a perspective view of an alignment device according to a first embodiment of the invention.

The following detailed description and appended drawings describe and illustrate various embodiments of the invention. The description and drawings serve to enable one skilled in the art to make and use the invention, and are not intended to limit the scope of the invention in any manner.

Alignment devices may comprise a base. A base is defined by first and second ends and first and second lateral sides. The base defines a first axis extending between a first end and a second end. The base defines a second axis extending between first and second lateral sides at the midway point of the first axis. Additionally, the base defines a first part and a second part demarcated by the second axis. The base may also define a first lateral surface and a second lateral surface, wherein the first and second lateral sides and first and second ends extend between the first lateral surface and the second lateral surface In some embodiments, the distance from the first end of the base to the first end point is shorter than the distance from the first end of the base to the second end point. Alternatively, in other embodiments the distance from first end of the base to the first end point is the same as the distance from the first end of the base to the second end point.

In some embodiments, the base may further comprise at least one alignment extension. The alignment extension may have several different embodiments. In some embodiments, an alignment extension may comprise a lateral alignment extension member that extends from the base laterally in a plane that is the same as or is parallel to the planar surface defined by the second lateral surface of the base. In other embodiments, the alignment extension may comprise one or more vertical alignment extension members as described in detail below. These vertical alignment extension members may comprise a vertical deployment member or an elongate member. In other embodiments, the alignment extension may comprise a vertical component with a planar extension. The vertical alignment extension member comprises an alignment indicia as used and defined in the application. These features are discussed in more detail below with description of embodiments of the present inventions.

The base may also comprise one or more alignment indicia. As used herein, "alignment indicia" may refer to one or more slots, lines, etched lines, markings, colored or printed lines, or structural features such as projections, elongate members, and extensions. Alignment indicia may include at least one selected from a group consisting of a boundary line and a putting sight line. In some embodiments, the at least one alignment indicia of the base may be located on the first lateral surface.

In some embodiments the alignment device can be made for a right-handed golfer, a left-handed, or both a right-handed golfer and a left-handed golfer. For embodiments constructed for only a right-handed golfer or a left-handed golfer, alignment indicia are only necessary on one side. For embodiments constructed for both right-handed golfers and left-handed golfers, alignment indicia are arranged on both sides in a symmetrical manner. Each side can comprise at least one alignment indicia on each side to assist the user in aligning the dominant eye of the user, the putter, the ball, and the hole.

In some embodiments, the base comprises at least one alignment indicia comprising a slot on a first part of the base, a second part of the base, or both the first and second parts of the base, wherein the slot is parallel to the second axis of the base. Additionally, or alternatively, the base may comprises at least one alignment indicia comprising a slot on a first part of the base, a second part of the base, or both the first and second parts of the base, wherein the slot is positioned at a predetermined angle relative to the second axis of the base.

A golf alignment device 10 according to a first embodiment of the present invention is shown generally in FIGS. 1-5. The alignment device 10 includes a base 11 for being positioned on a practice putting surface. The base 11 has a length sufficient to provide stability to the device 10, and to assume the surface orientation of the putting surface under the base 11, and a pointed front end and line down the center along the first axis of the base 11 to indicate the proper orientation. An exemplary embodiment of the suitable base 11 can be constructed of a 1 inch by 1 inch body having a length of approximately 12-24 inches. It is understood that other dimensions can be used which result in the base 11 being taller, shorter, wider, narrower, longer, or shorter. In the embodiment shown in FIGS. 1-5, the base 11 is produced from wood. However, as illustrated by the embodiments shown in FIGS. 6-21, the base 11 can be produced from any suitable material having desirable qualities such as plastic, metal, or another suitable material, for example. The device 10 also includes one or more elongate members 12, such as a dowel or elongate rod with a substantially circular, rectangular, square, triangular cross-section, positioned on the base 11 and extending perpendicularly upwardly from the base 11. The base 11 assumes the orientation of a supporting surface in both front-to-back and side-to-side directions, so that, for example, when the base is on a sidehill area of the practice surface, the one or more elongate members 12 provide a reference for the golfer to visualize proper alignment. The one or more elongate members 12 may be detachable from the base 11 and attachable to an outer portion thereof or disposed within an aperture formed in the base 11 for storage purposes.

The base 11 comprises at least one alignment indicia comprising a slot. The alignment indicia 14 is formed in or on the base 11 adjacent one end thereof. The alignment indicia 14 is formed at an acute angle with respect to the first axis of the base 11. As shown, the alignment indicia 14 extends from the first axis of the base 11 to a first edge of the base 11. An alignment indicia 16 comprising may be formed in or on the base 11 adjacent the one end thereof. The alignment indicia 16 is formed at an acute angle with respect to a longitudinal axis of the base 11. As shown, the alignment indicia 16 extends from the first axis of the base 11 to a second edge of the base 11.

As shown, an alignment indicia 13 is formed in or on the base 11 and extends from the first axis at the elongate member of the base 11 to the first edge of the base 11. An alignment indicia 15 is formed in or on the base 11 and extends from the first axis at the elongate member 12 of the base 11 to the second edge of the base 11. In some embodiments, alignment indicia 13 and 15 are formed perpendicular to the first axis of the base 11 at the elongate member 12 and are perpendicular to the elongate member 12 as well.

In some embodiments, at least one selected from the group consisting of alignment indicia 13, 14, 15, 16, or any combination thereof may be structured to receive and matingly engage with the elongate member 12, or the one or more elongate members 12. In some embodiments, the elongate member 12, or the one or more elongate member 12 may be hidgedly connected to the base 11 via a hinge at a first end of the elongate member 12 such that the golfer may rotate (e.g., collapse) each elongate member 12 into the corresponding alignment indicia for storage, transportation, advanced practice (e.g., putting without the assistance of the elongate member 12), and so forth.

Figure 2:
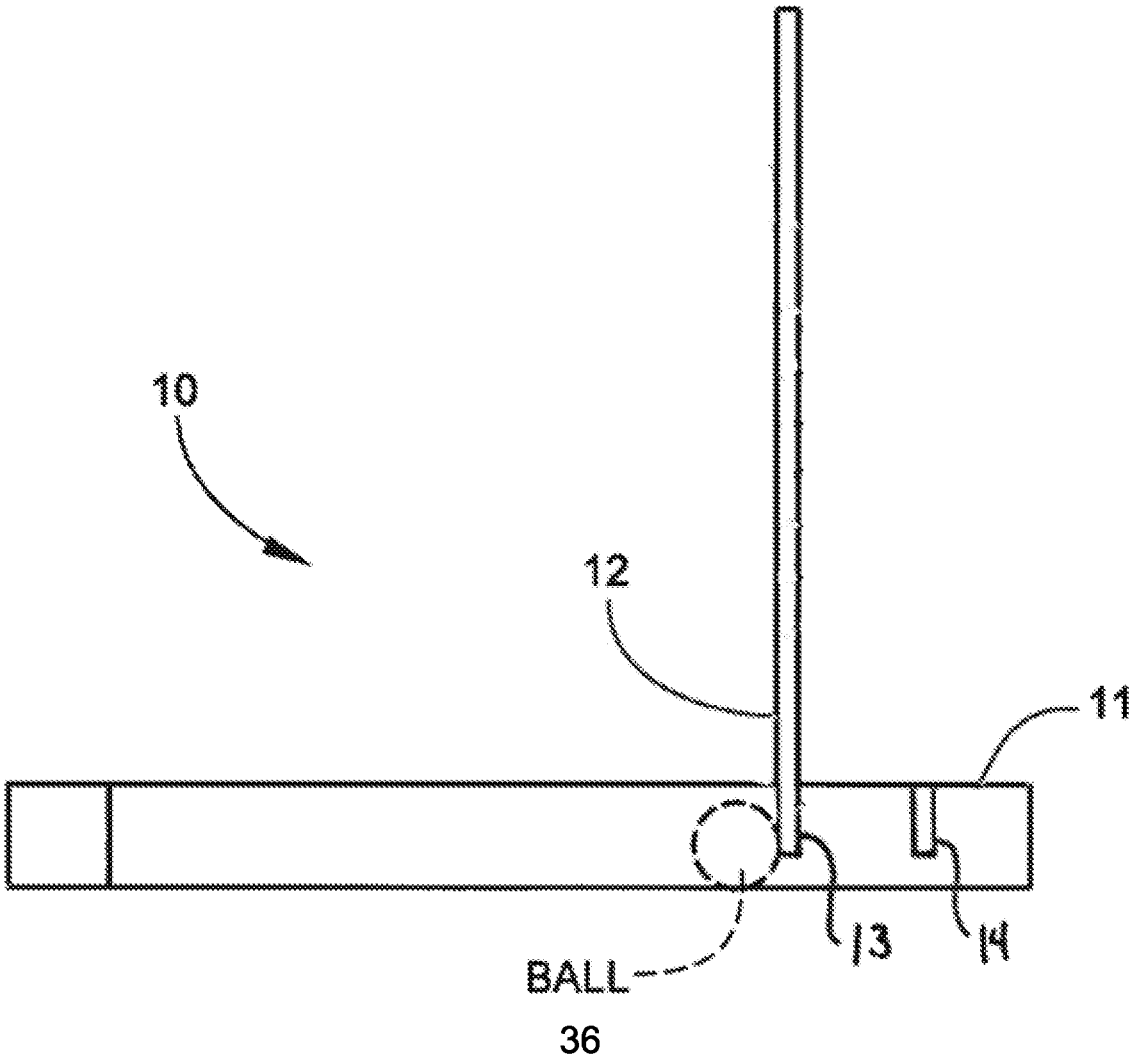
FIG. 2 is a side elevation of the alignment device shown in FIG. 1.
Figure 3A:
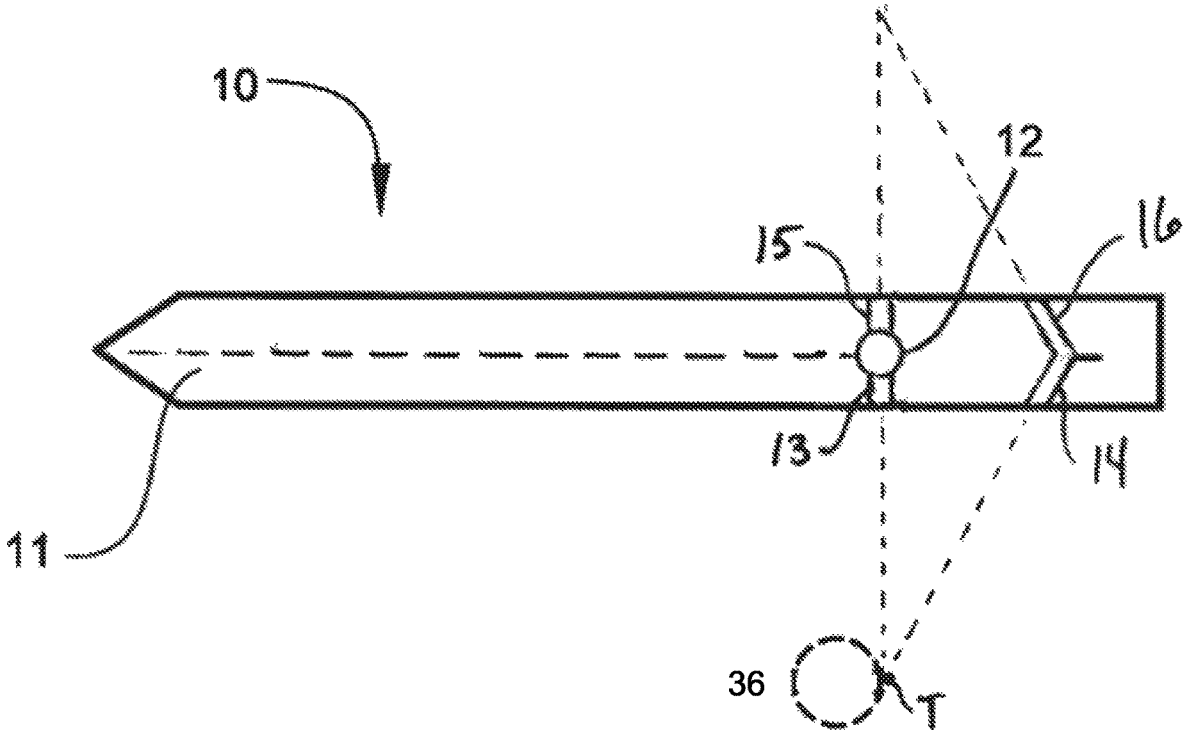
FIG. 3A is a top plan view of the alignment device shown in FIG. 1, illustrating proper alignment in relation to the dominant eye for both right and left-handed golfers.
Figure 3B:
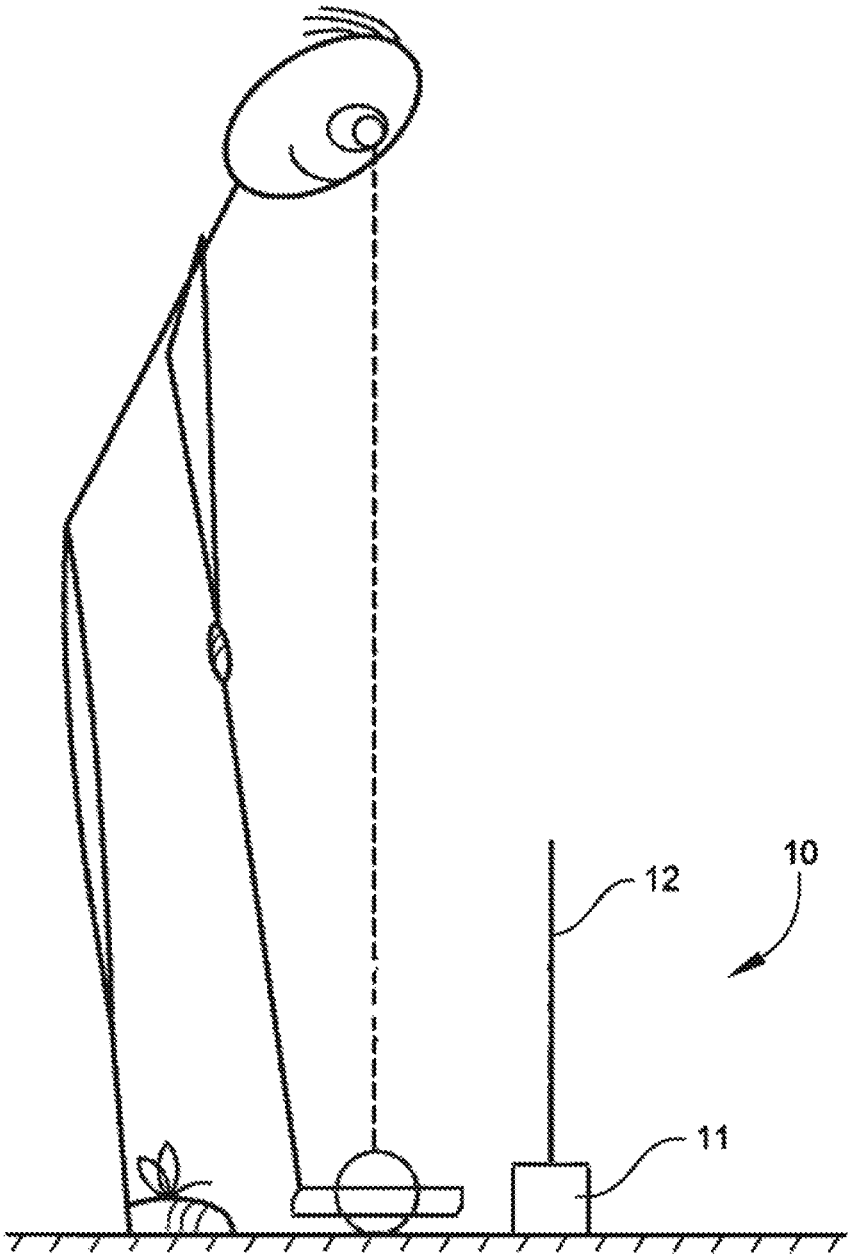
FIG. 3B shows the orientation of a golfer in relation to the position shown in FIG. 3A.

By reference to FIGS. 2 and 3A, it is shown that the ball is intended to be positioned with the back of the ball tangent to a first line which is an extension of the alignment indicia 13 and extending substantially perpendicular to both the longitudinal axis of the base 11 and the elongate member 12 from the first edge of the base 11. A lateral position of the ball with respect to the longitudinal axis of the base 11 on the first line is established by an intersection of the first line and a second line which is an extension of the alignment indicia. In other words, the first line and the second line intersect at a tangent point T of the ball on the first line. In the embodiment shown, a distance from the first edge of the base 11 may be about 5-6 inches, although other distances can be used as desired. The ball position shown in the drawings is for a right-handed golfer, as is the remainder of the description. For a left-handed golfer, the ball is positioned with the back of the ball tangent to a third line which is an extension of the alignment indicia 15 and extending substantially perpendicular to both the first axis of the base 11 and the elongate member 12 from the second edge of the base 11. A lateral position of the ball with respect to the first axis of the base 11 on the third line is established by an intersection of the third line and a fourth line which is an extension of the second alignment indicia. In other words, the third line and the fourth line intersect at a tangent point of the ball on the third line. The location of the tangent point in relation to the dominant eye of the golfer allows adjustment of the eye position sufficient to place the dominant eye in a properly-aligned position. The position of the dominant eye is essentially in vertical alignment with the tangent point T, although the precise position may be based upon a preference of the golfer. The golfer addressing the ball in the position for the right-hand golfer is shown in FIG. 3B, with the dominant eye of the golfer directly, perpendicularly over the rear of the ball at the tangent point T during a setup for putting the ball. To determine whether the setup is proper, the golfer must check two items. First, the golfer must determine the intersection points of the first line and the second line to position the ball at the tangent point T. Second, the elongate member 12 provides a reference to help the golfer position their body properly for a slope of the putting surface, as will be further explained hereinbelow. By ensuring these two items are satisfied, the golfer is positioned bidirectionally perpendicular to the slope of the putting surface and bidirectionally parallel to the one or more elongate members 12, no matter the slope of the putting surface. Essentially, in order to meet the two items, the golfer adjusts their weight forward, backward, left right, or a combination of these when the slope is not zero. For example, if the putting surface slopes away from the golfer, they weight may be more on the toes of the golfer. If the putting surface slopes towards the golfer, their weight may be more on their heels. If the putt is uphill, the weight would shift to the right-handed golfer's right side, and if downhill the weight would shift to the right-handed putter's left side and, conversely, for the left-handed golfer.

When the alignment indicia 13, 14, for a right-handed golfer or alignment indicia 15, 16, for a left-handed golfer are used (as shown in the drawings), further alignment assistance is provided for the golfer. In order to determine when the dominant eye is over the ball and in line with the alignment indicia 13, 14, for a right-handed golfer and alignment indicia 15, 16, for a left-handed golfer as described hereinabove, the alignment indicia 13, 14, 15, 16 provide a further visual to ensure alignment. If the dominant eye of the right-handed golfer is forward of or rearward of the alignment indicia 13, for example, one of the walls of the alignment indicia 13 will not be visible to the golfer. Similarly, if the eye of the right-handed golfer is too close to the base or too far away from the base from the tangent point T, one of the walls of the alignment indicia 14 will not be visible to the golfer. Thus, the golfer can adjust forward, backward, in, or out to ensure the dominant eye is perfectly in line with the appropriate alignment indicia 13, 14, for a right-handed golfer or alignment indicia 15, 16, for a left-handed golfer. In embodiments where the alignment indicia comprises at least one slot, at least one selected from the group consisting of (i) the walls, and (ii) the base of the slot may be provided as white, yellow, green, or other color in order to make the visual alignment easier for the golfer. Accordingly, when the alignment indicia 13, 14, 15, 16 are wide, there may be a greater visibility and thus ease of use for the golfer. However, when the alignment indicia 13, 14, 15, 16 are narrow, there may be a greater accuracy in the alignment of the dominant eye.

Figure 4:
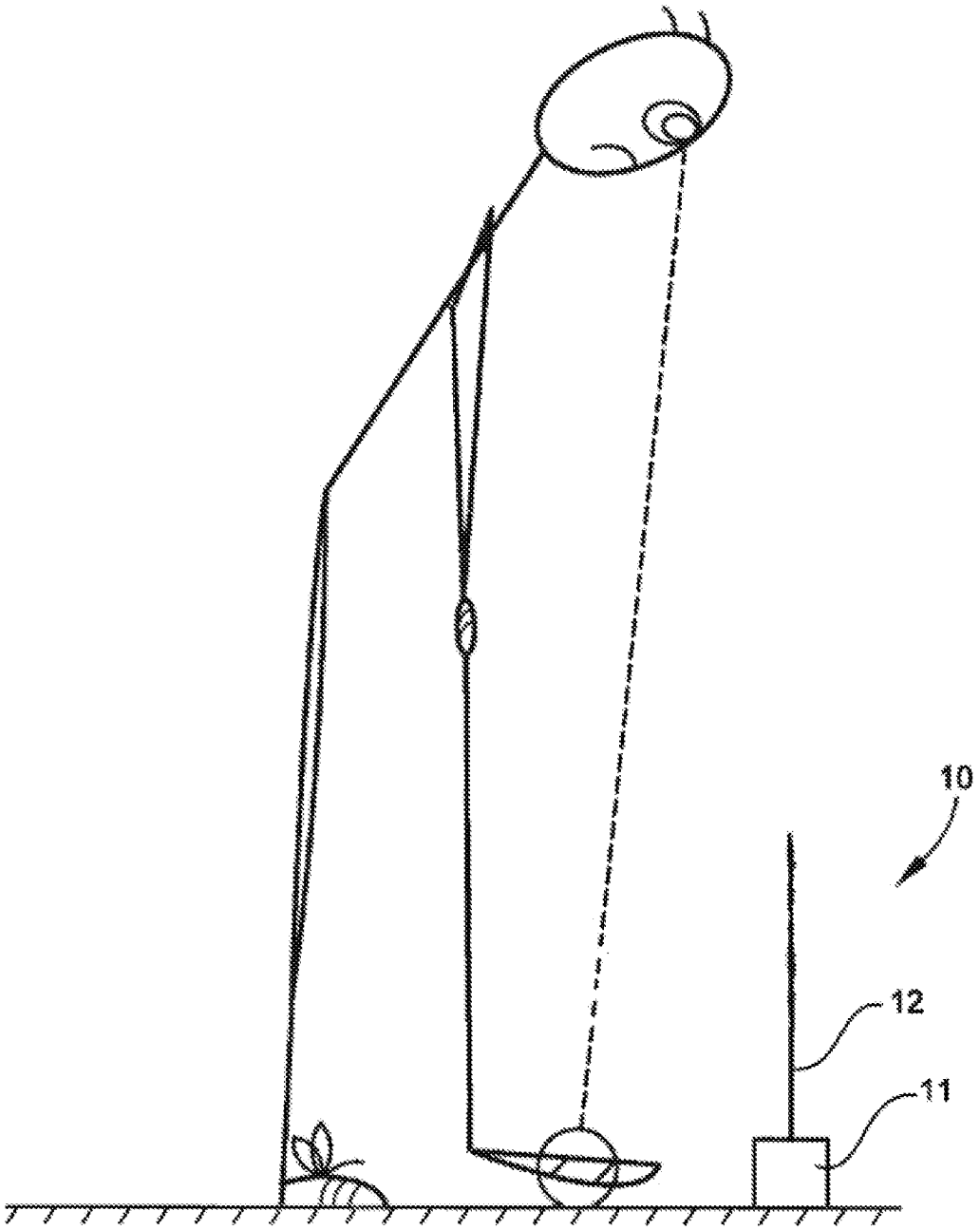
FIG. 4 shows the orientation of the golfer in one misalignment.
Figure 5:
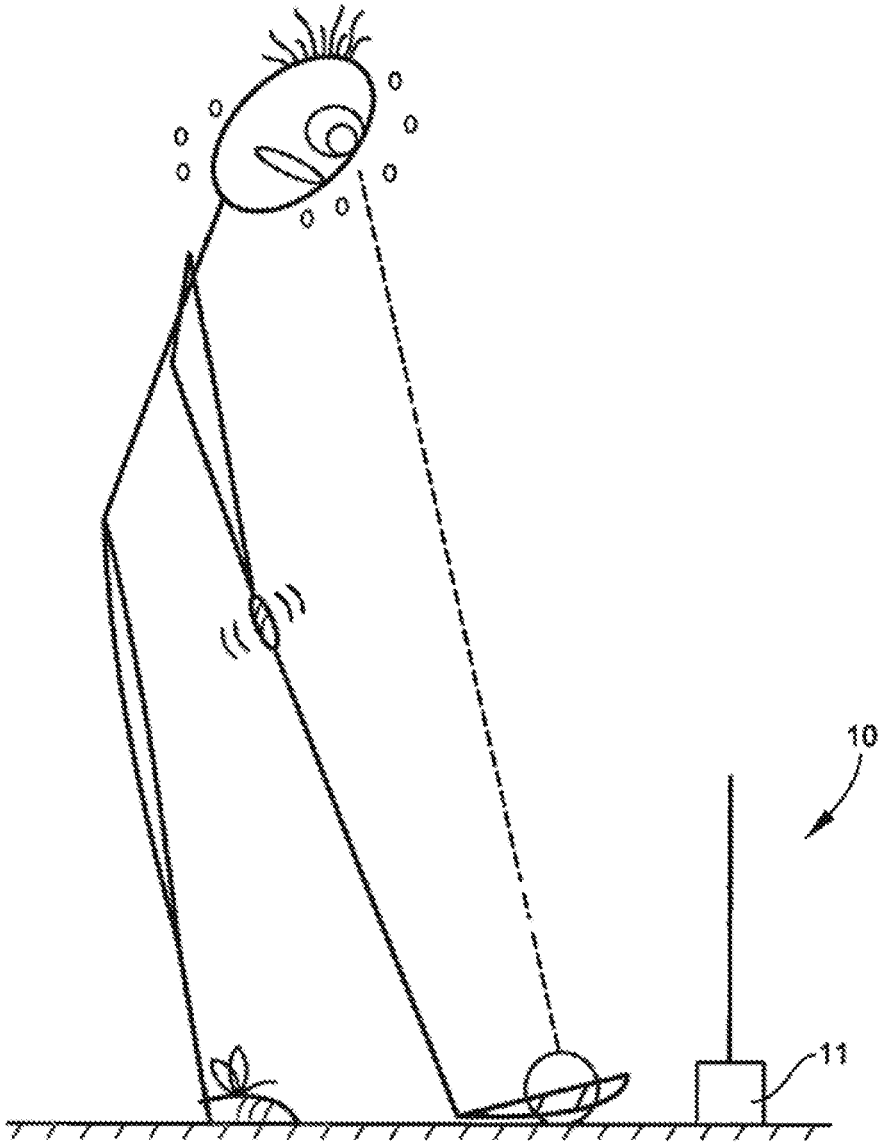
FIG. 5 shows the orientation of the golfer in another misalignment.

Referring now to FIG. 4 a misalignment of the golfer is illustrated, indicating that the dominant eye is positioned inwardly towards the alignment device 10 of the proper vertical alignment position. FIG. 5 shows another a misalignment wherein the dominant eye is positioned outwardly from the alignment device 10 of the proper vertical alignment position. Other misalignments result when the dominant eye is positioned rearwardly of the vertical alignment position and when the dominant eye is positioned forwardly of the vertical alignment position.

Misalignments typically will occur due to a slope of the putting surface that must be considered when addressing the ball, such as a straight flat lie, straight downhill lie, straight uphill lie, left to right uphill lie, left to right downhill lie, right to left uphill lie, right to left downhill lie, straight sidehill lie that ultimately breaks left, and straight sidehill lie that ultimately breaks right. When positioned on the putting surface, the base 11 conforms to the slope of the putting surface, meaning it will cause the one or more elongate members 12 to move away from vertical and provide the golfer with a visual reference of a slope angle of the green. The golfer can accordingly adjust their posture to account for the slope angle. For example, when facing a straight downhill putt, the golfer must adjust their stance to shift their weight forward or lean forward slightly in order to keep a swing plane of the putter parallel with the slope angle of the putting surface. The elongate member acts as a guide for which direction the golfer must shift in order to maintain a proper swing plane. Thus, the alignment device 10 helps the golfer maintain a consistent setup for each variation in the slope of the putting surface, which helps the golfer maintain consistence in the putting stroke for each variation in the slope of the putting surface.

Further, as the golfer practices putting with the alignment device 10, and encounters the misalignments described in this application, correction can be made by reorienting the dominant eye so as to result in the view shown in FIGS. 3A and 3B. Use of the device also permits a golfer to practice putting in a manner that permits association of putts missed to the left or right of the hole with various misalignments as described above and illustrated in the drawings. Over time, visual feedback and correction permit the golfer to putt during regular play without the alignment device by retaining the mental impression of the proper alignment, thereby increasing the probability of striking the ball in such a manner that the ball travels in the direction actually perceived by the golfer. In other words, the consistency experienced helps the golfer improve muscle memory and maximize accuracy of putts.

One benefit of the alignment device 10 is that it provides an unobstructed view of the target line of travel of the golf ball. Once properly positioned, the golfer can focus on the line, aligning the putter to the line, and stroking the putt without a visual interference. Once the stroke is made, the golfer can also then check his/her eye alignment to see if he/she has maintained his/her position or moved during the stroke which would result in misalignment of the putter face to the line. This provides a diagnostic benefit of the training aid. Known devices don't offer these benefits and advantages.

Additional embodiments of the alignment device 10 are described hereinafter with respect to FIGS. 6-21. Additional embodiments may provide for a compact design of the alignment device 10 to allow for ease in portability of the alignment device 10. Accordingly, a golfer may carry his/her alignment device 10 to and from practice greens and golf courses, stow in a golf bag or backpack, and so forth.

Figure 6:
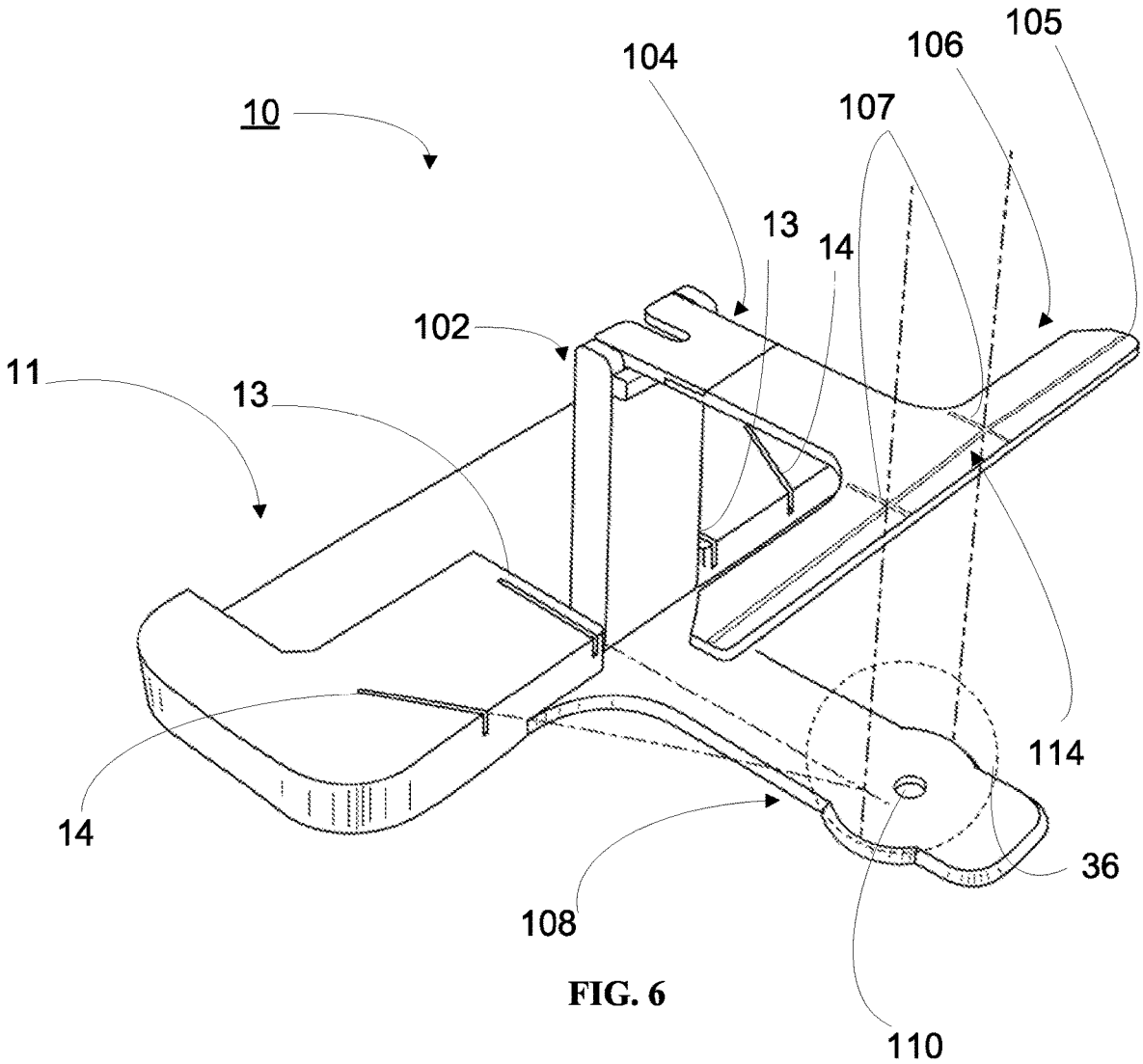
FIG. 6 is a perspective view of an alignment device according to a second embodiment of the invention wherein a vertical alignment extension member is in its deployed state.
Figure 7:
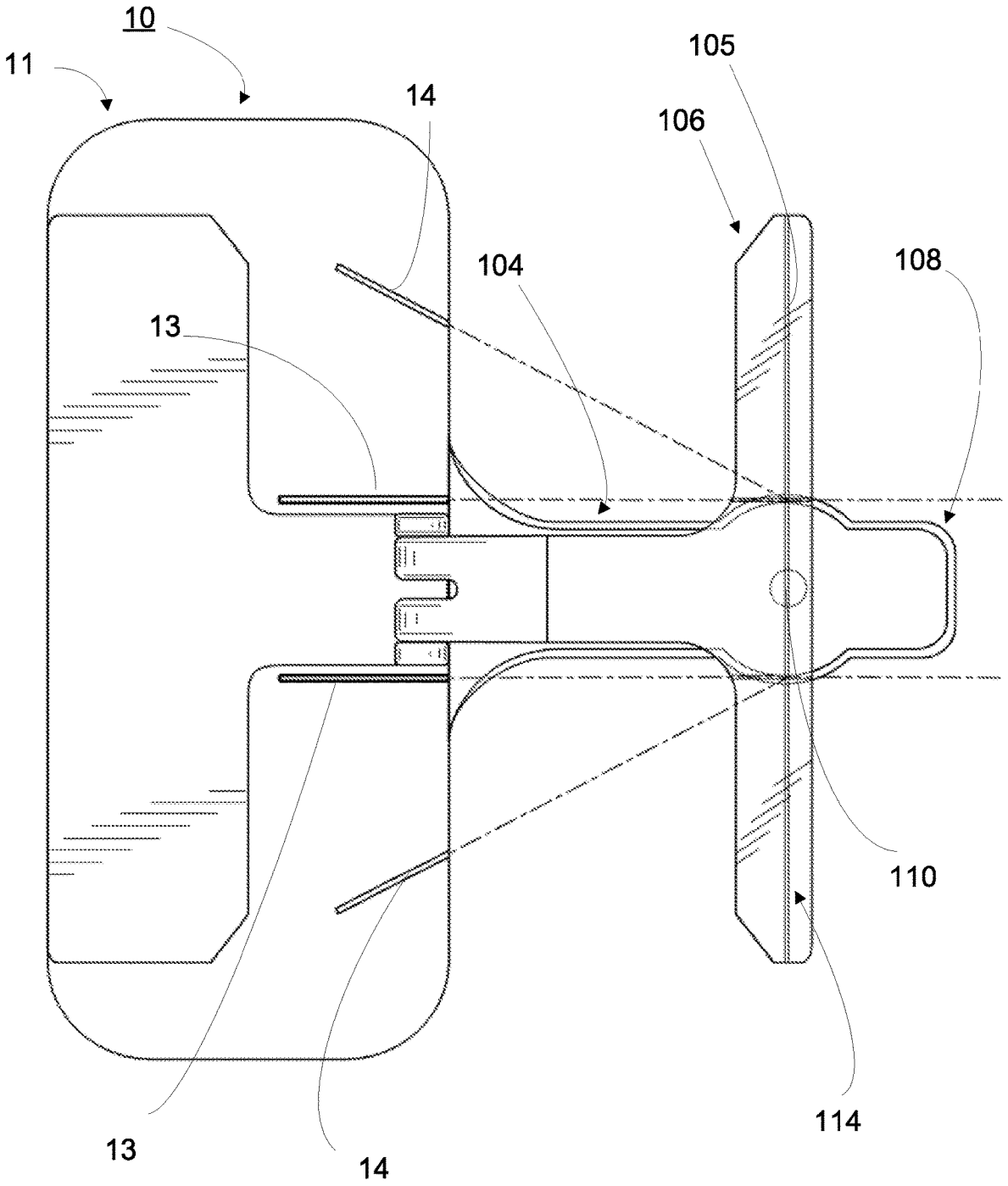
FIG. 7 is a top plan view of the alignment device shown in FIG. 6.
Figure 8:
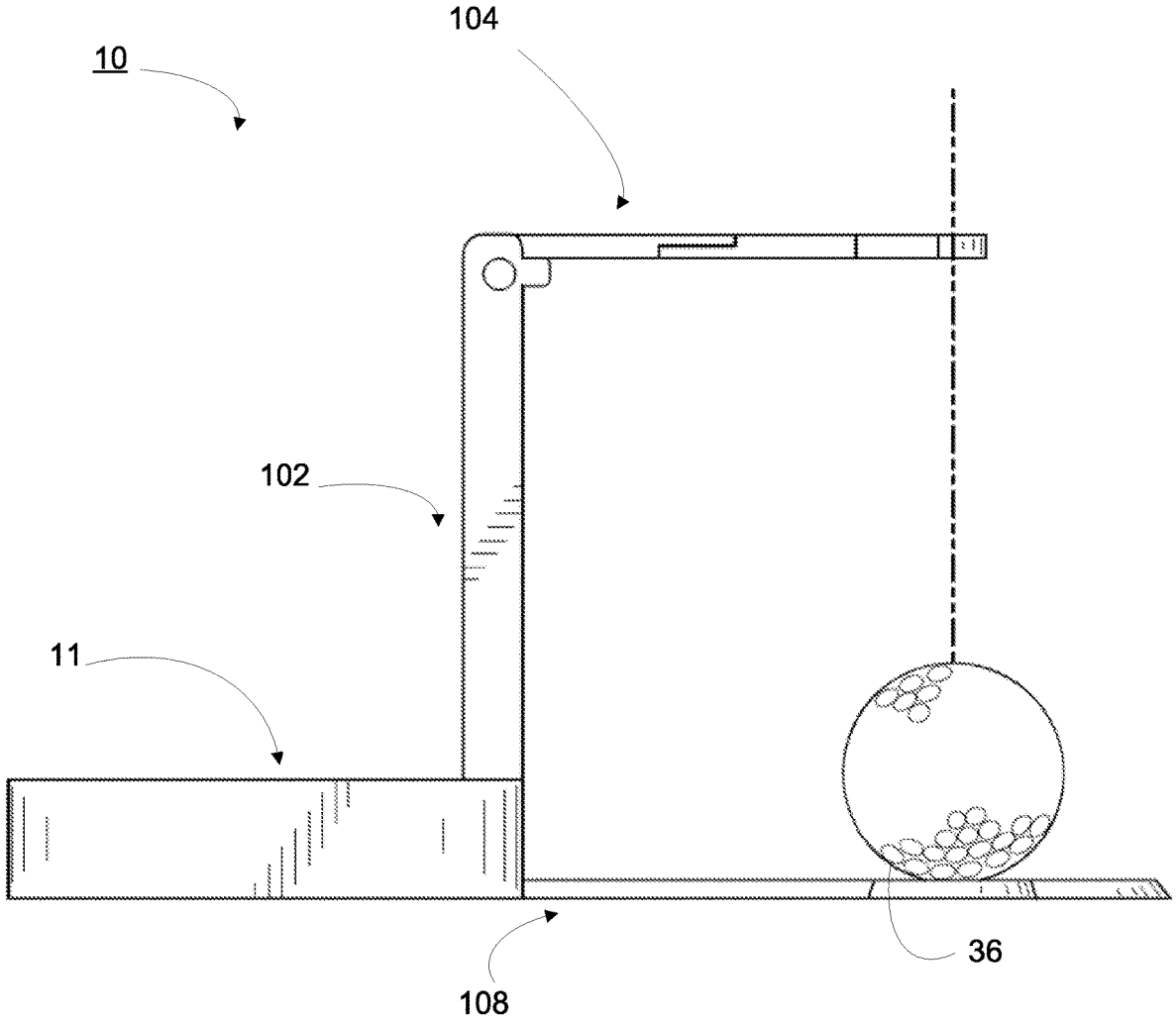
FIG. 8 is a side elevation of the alignment device shown in FIG. 6.
Figure 9:
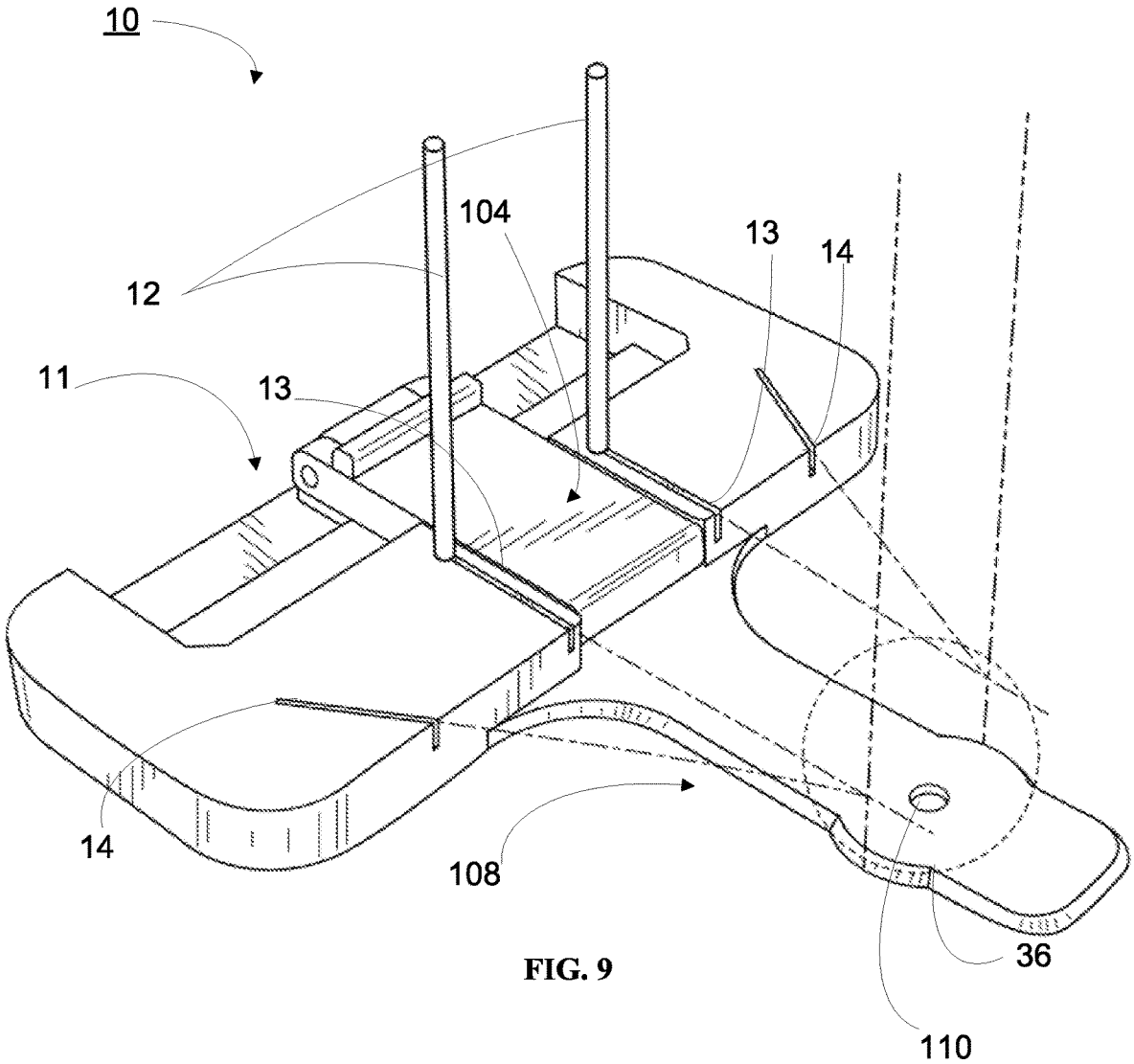
FIG. 9 is a perspective view of an alignment device according to a third embodiment of the invention wherein vertical alignment extension members are in their deployed state, and the alignment extension is in its stored and non-deployed state.
Figure 10:
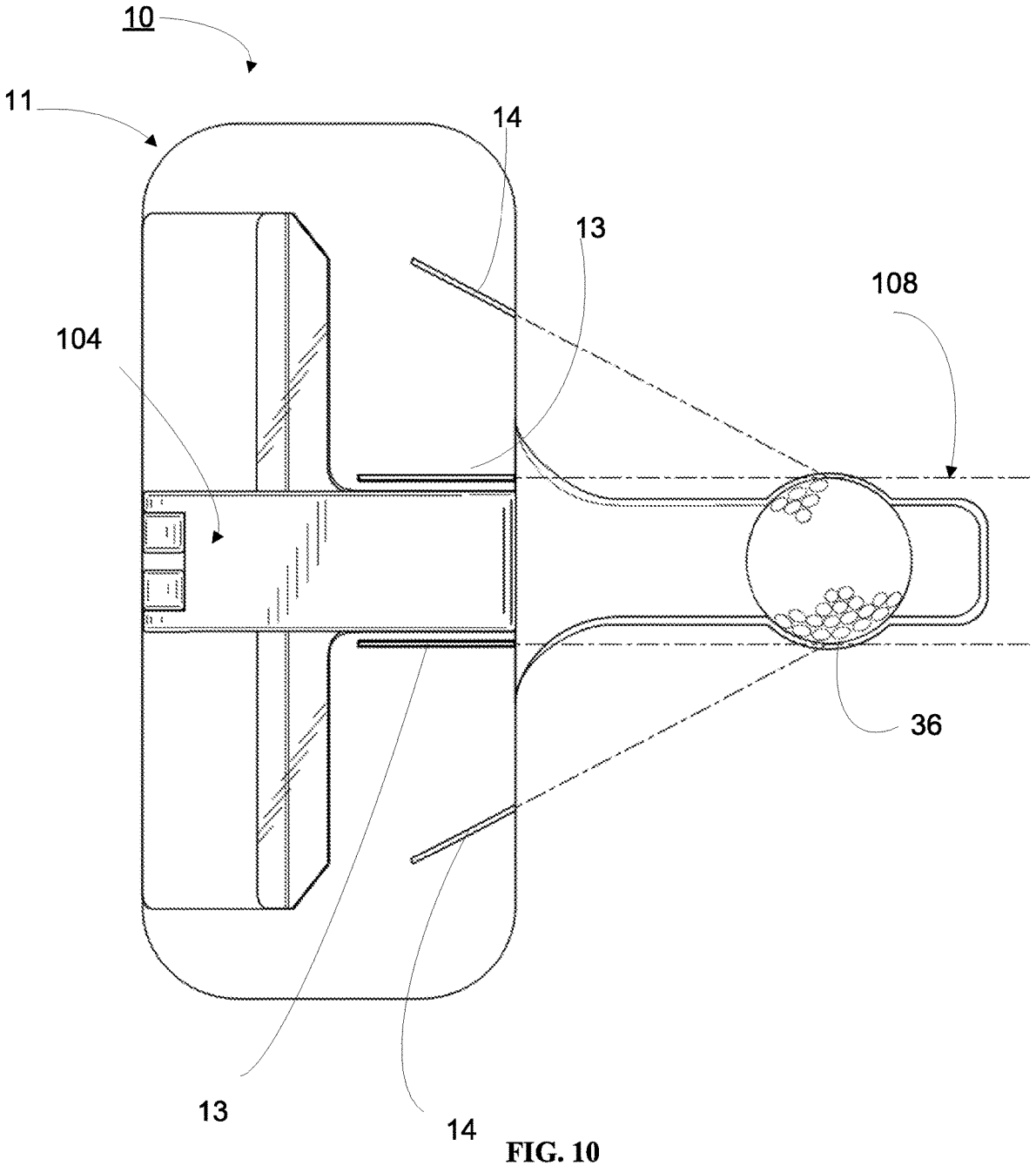
FIG. 10 is a top plan view of the alignment device shown in FIG. 9 in which the vertical alignment extension members have been removed and stored.
Figure 11:
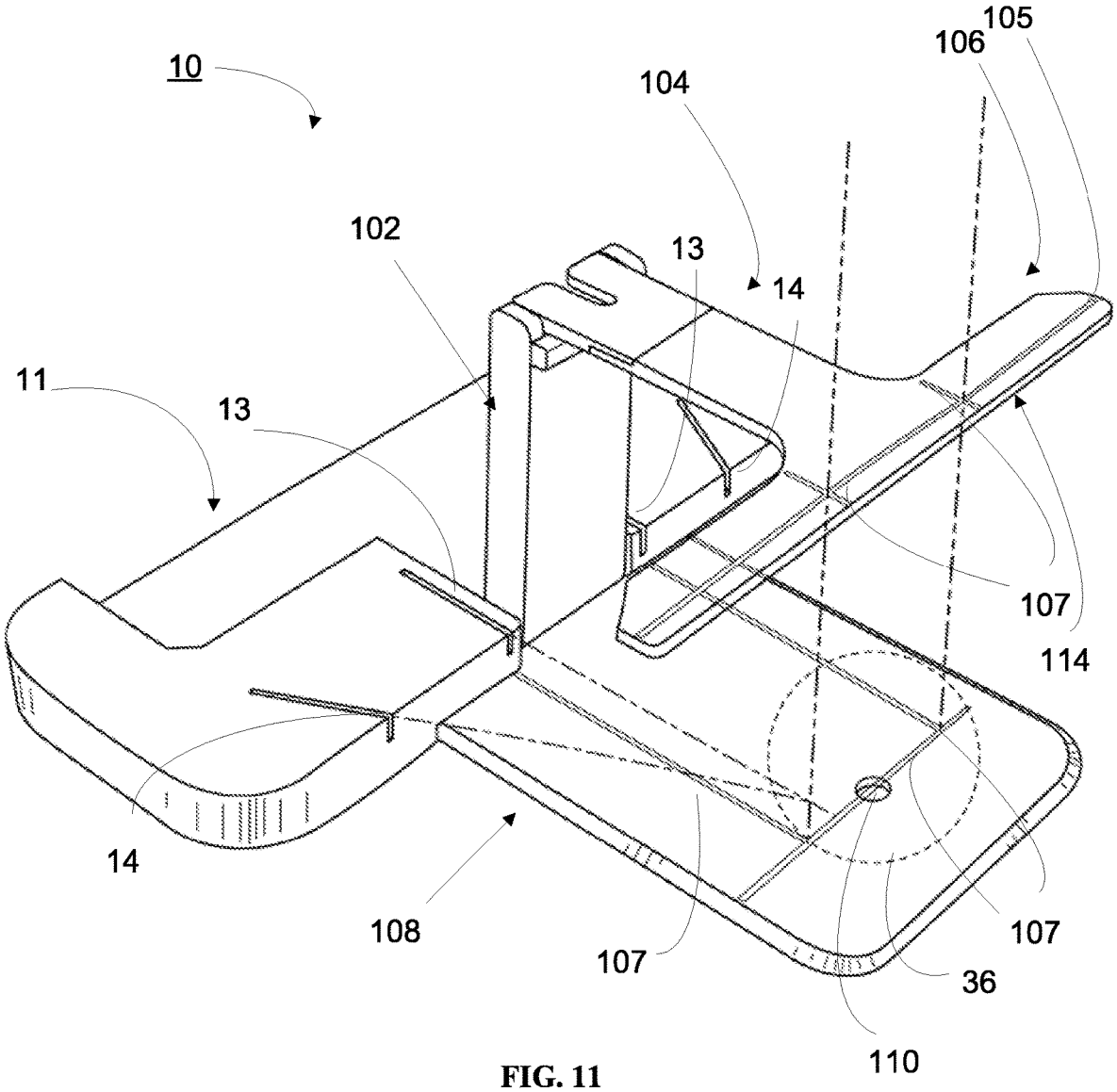
FIG. 11 is a perspective view of an alignment device according to a fourth embodiment of the invention wherein a vertical alignment extension member is in its deployed state.
Figure 12:
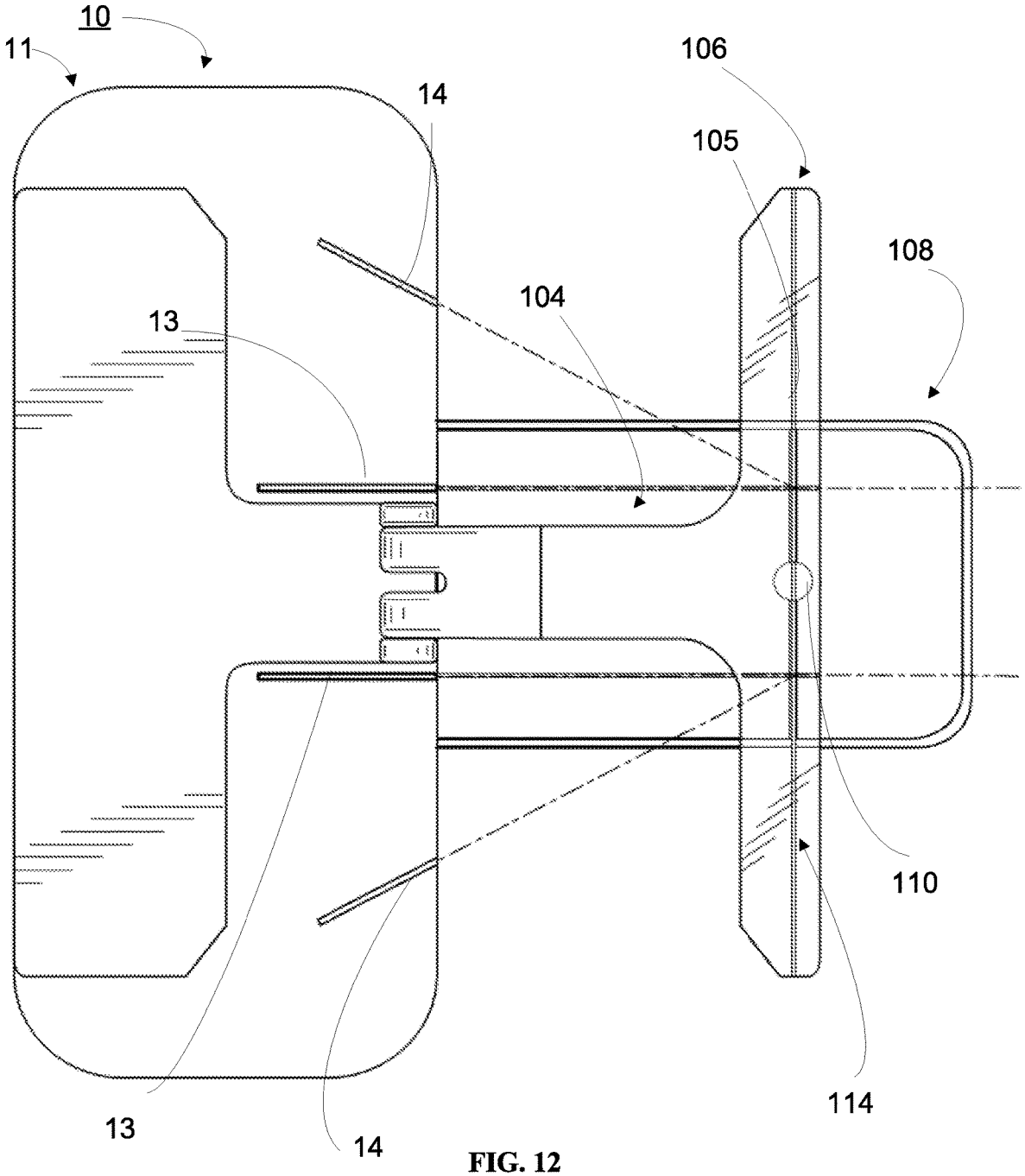
FIG. 12 is a top plan view of the alignment device shown in FIG. 11.
Figure 13:
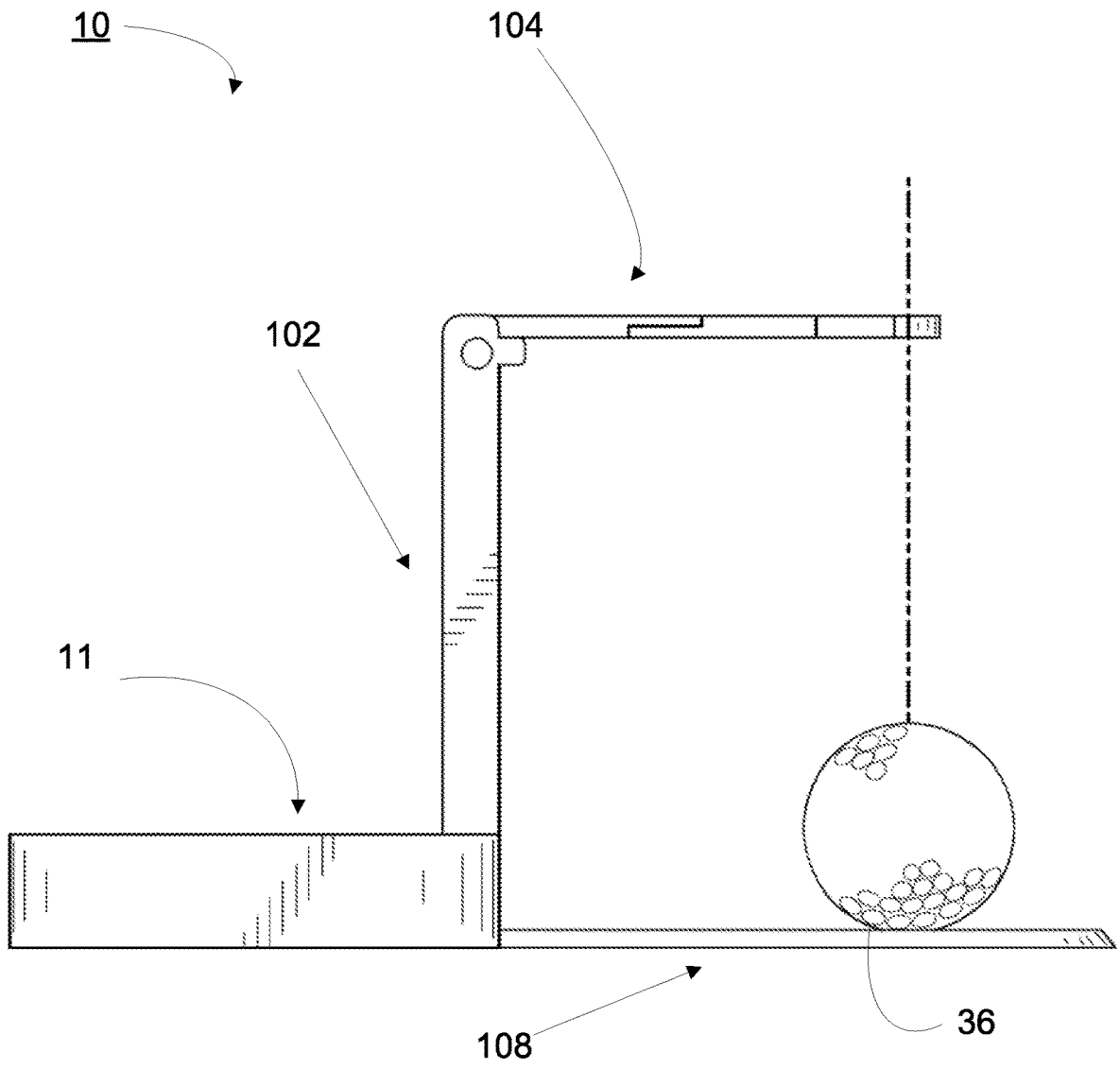
FIG. 13 is a side elevation of the alignment device shown in FIG. 11.
Figure 14:
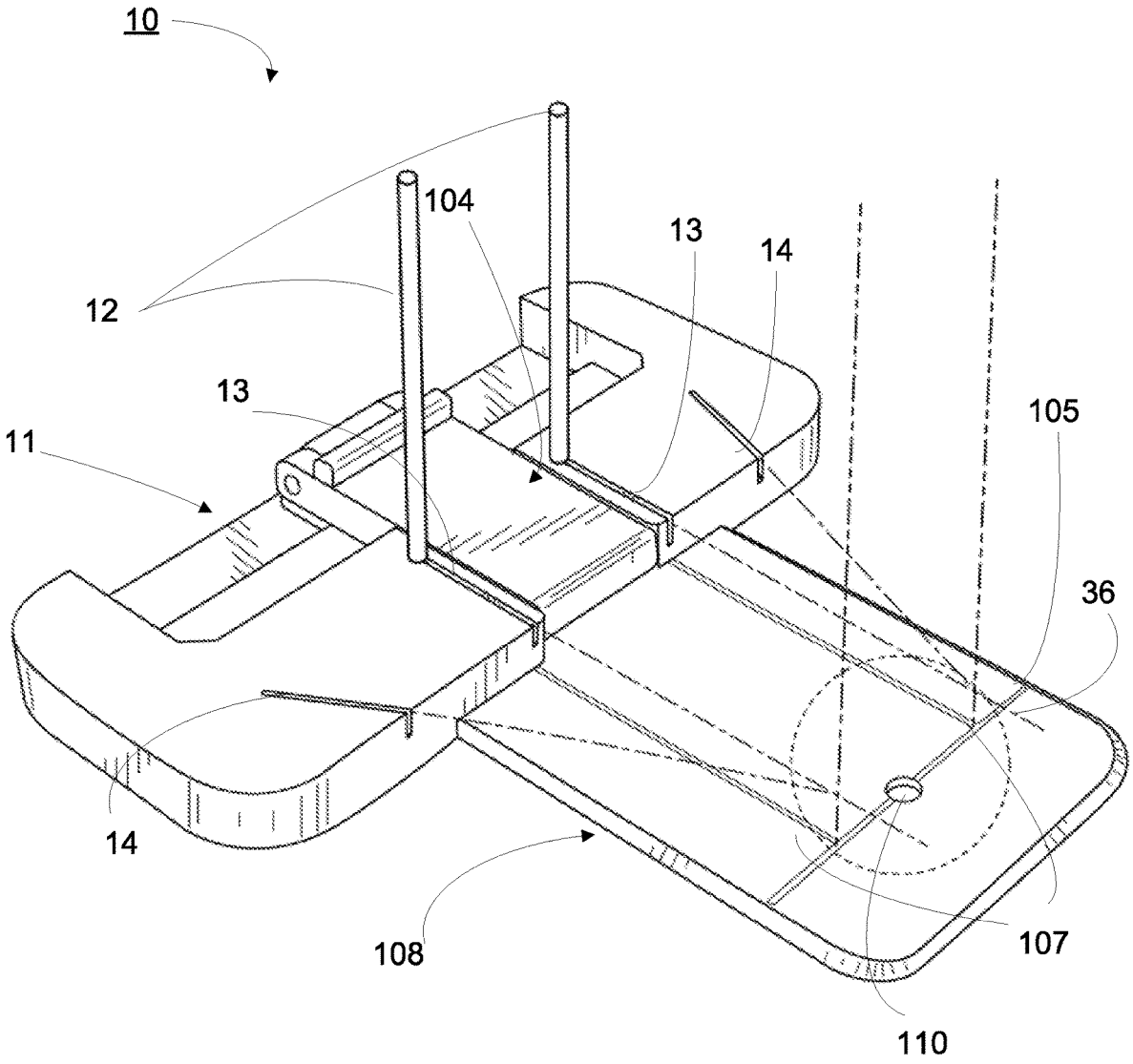
FIG. 14 is a perspective view of an alignment device according to a fifth embodiment of the invention wherein vertical alignment extension members are in their deployed state.
Figure 15:
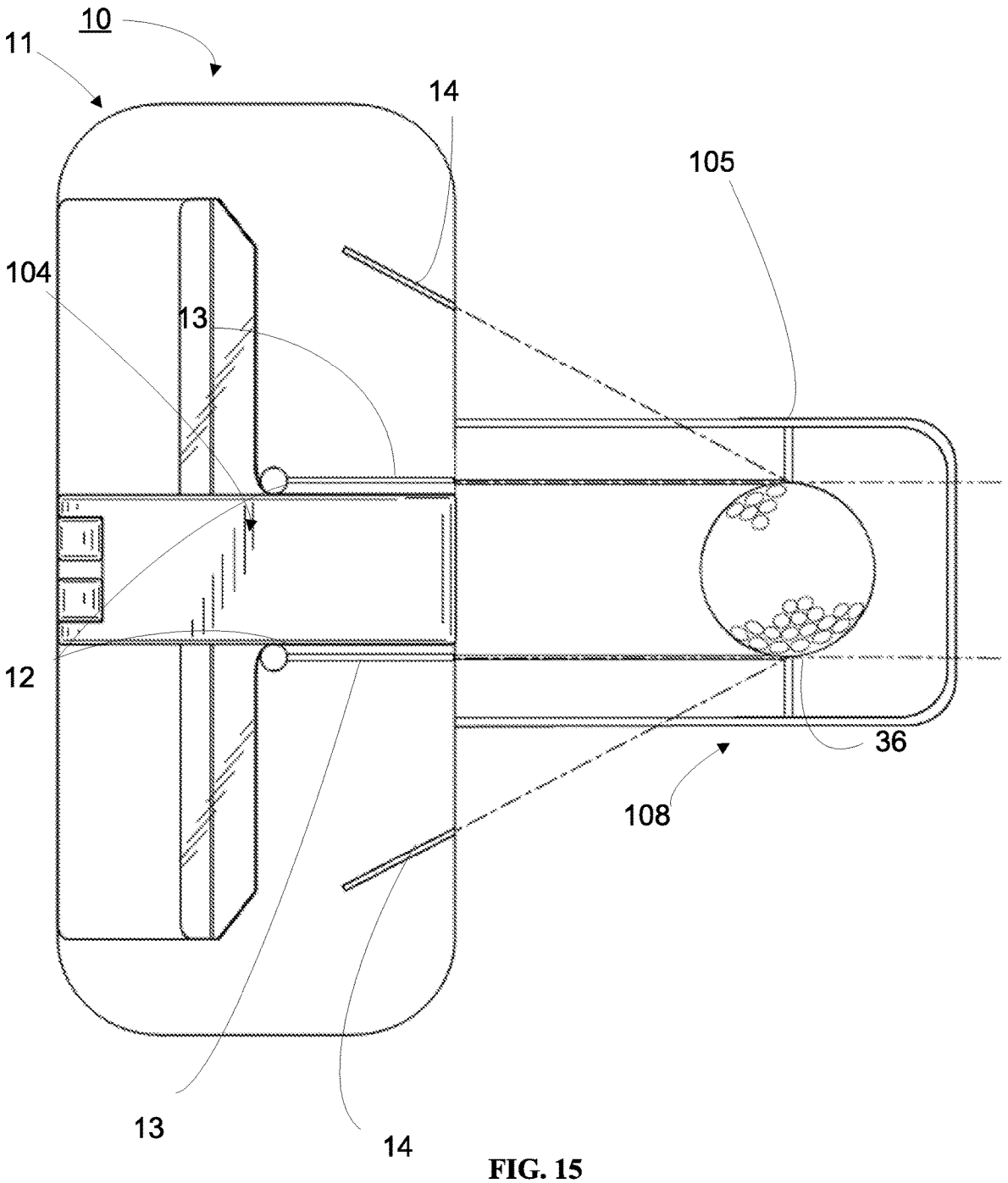
FIG. 15 is a top plan view of the alignment device shown in FIG. 14.

Referring now to FIGS. 6-8, a first end of a vertical alignment extension member comprising a support member 102 may be rotatably coupled to the base 11 via a hinge, socket, or living hinge, such that in a closed position a first face of the support member 102 is adjacent a first face of base 11. Upon rotating the support member 102 to move from a closed position (such as that which is illustrated in FIG. 9) to an open position (such as that which is illustrated in FIG. 6), the first face of the support member 102 may be substantially perpendicular to the first face of the base 11.

As illustrated in FIG. 6, in some embodiments, the base 11 may include alignment indicia 13, 14 each comprising a slot. On one half of the base 11, the alignment indicia 13 is formed in or on the base 11 and extends from the first axis of the base 11 at a predetermined distance from the first axis to the first edge of the base 11 and is formed parallel the second axis of the base 11. On the same half of the base, the alignment indicia 14 is formed in or on the base 11 adjacent one end thereof. The alignment indicia 14 is formed at an acute angle with respect to the first axis of the base 11. As shown, the alignment indicia 14 extends from the first axis of the base 11 to a first edge of the base 11, although other length of extension are contemplated, including extending from the first side to the second side of the base 11, or to and from any point in between the first and second sides of the base 11.

In some embodiments, the base 11 may include two (2) alignment indicia 13 and two (2) alignment indicia 14, with each alignment indicia 13 and alignment indicia 14 having a corresponding alignment indicia 13 and alignment indicia 14, such as to form symmetrical alignment indicia about the second axis of the base 11. In this way, the alignment device may accommodate both left-handed and right-handed golfers.

As illustrated in FIG. 6, the vertical alignment extension member may further comprise a first lateral alignment extension member 104 laterally extending from the support member 102 at a predetermined distance (i.e., height) from the base 11. In some embodiments, such as that which is illustrated in at least FIG. 9, the vertical alignment extension member 102 comprises an alignment indicia as used and defined herein. In some embodiments, the lateral alignment extension member 104 may be an integral feature of the support member 102 such as to form a unitary and inseparable body. In other embodiments, such as those which are illustrated in FIGS. 6-19, lateral alignment extension member 104 may be rotatably coupled to the support member 102 at one end of the lateral alignment extension member 104 such as to facilitate the deployment (e.g., extension), or retraction (e.g., closing) of the lateral alignment extension member 104. In the open position, the support member 102 extends from the first lateral surface of the base 11 and a lateral alignment extension member 104 extend from the base 11 laterally in a plane that is substantially parallel to the planar surface defined by the second lateral surface of the base.

The alignment device 10 may further comprise a second lateral alignment extension member 108 extending from the base 11 to a predetermined distance and coplanar and substantially parallel to the putting surface or the base 11. In some embodiments, the lateral alignment extension member 108 may be detachable such as to store and transport the lateral alignment extension member 108 in a secure and compact manner. In some embodiments, the base 11 may be structured to receive the lateral alignment extension member 108 such as in a recess of the base 11, pocket, or the like. In yet additional embodiments, the lateral alignment extension member 108 may be rotatably coupled to the base 11 via a hinge, living hinge, or the like.

As illustrated in FIGS. 6-19, the lateral alignment extension member 108 may include an aperture 110 structured to receive the golf ball and properly position the golf ball with respect to the alignment device 10. In some embodiments, the aperture 110 may be a dimple, recessed portion, or other curved surface of the lateral alignment extension member 108 such that the golf ball is loosely held in position. Referring now to FIGS. 17-19, in some embodiments the lateral alignment extension member may be structured with a recess 112 to surround the outer surface of the golf ball without impeding the directional travel of the golf ball along the putting surface when a golfer addresses the golf ball.

Referring now to FIGS. 6-8, 11-13, and 16-17 the lateral alignment extension member 104 may include a cross member 106 perpendicularly intersecting the lateral alignment extension member 104. Cross member 106 may be composed of any suitable material such plastic, metal, or composite, and may be transparent, translucent, or opaque in appearance. In some embodiments, cross member 106 may also be structured with alignment indicia 114 which may be etched, molded, formed, printed, machined, or otherwise marked on to the cross member 106. The alignment indicia 114 may include a putting sight line 105 substantially oriented relative the cross member 106 in the desired direction of travel of the golf ball. The alignment indicia 114 may also include one or more boundary lines 107 substantially perpendicular to and intersecting the putting sight line 105 at a predetermined position to form a "crosshair". The one or more boundary lines 107 allow for the preferred line-of-sight eye positioning with the golf ball 36 being positioned with its impact point visually tangent to a boundary line 107 and with the putting sight line 105 visually bisecting the ball 36 from the golfer's perspective while viewing the golf ball 36 through the cross member 106.

Referring now to FIGS. 11-15, the lateral alignment extension member 108 may similarly be structured with the alignment indicia 114 which may be etched, molded, formed, printed, machined, or otherwise marked on to lateral alignment extension member 108. Indicia 114 may include a putting sight line 105 substantially oriented relative the lateral alignment extension member 108 in the desired direction of travel of the golf ball. Alignment indicia 114 may also include one or more boundary lines 107 substantially perpendicular to the putting sight line 105. The one or more boundary lines 107 allow for the preferred line-of-sight eye positioning with the golf ball 36 being positioned with its impact point visually tangent to a boundary line and with the putting sight line 105 visually bisecting the ball 36. In this way golfers may utilize the alignment indicia 114 in a less restrictive manner (e.g., without the use of the cross member 106, and instead only relying on the alignment indicia 114 of the lateral alignment extension member 108) while still benefiting from the additional aid of the alignment indicia 114.

Figure 16:
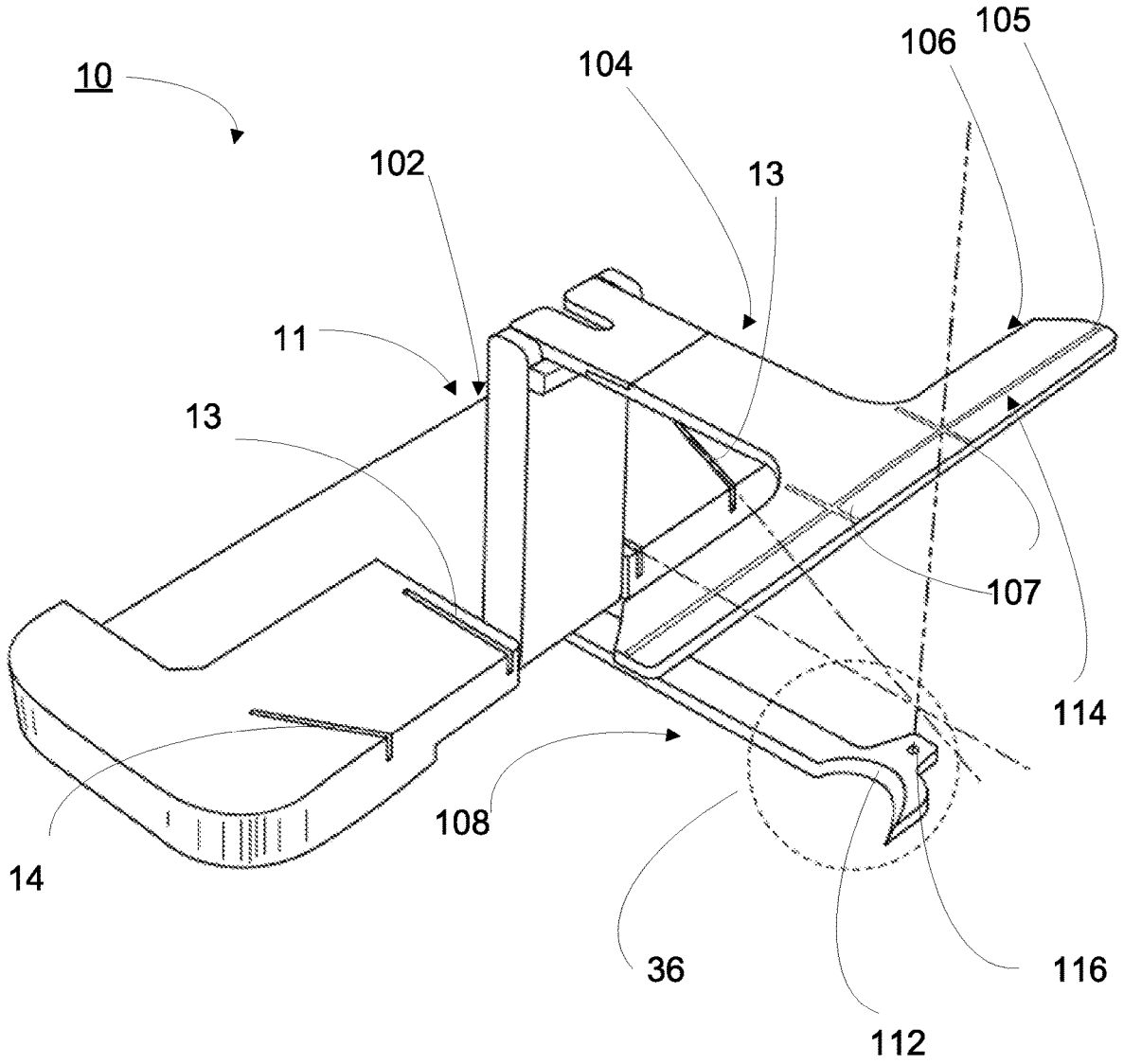
FIG. 16 is a perspective view of an alignment device according to a sixth embodiment of the invention wherein a vertical alignment extension member is in its deployed state.
Figure 17:
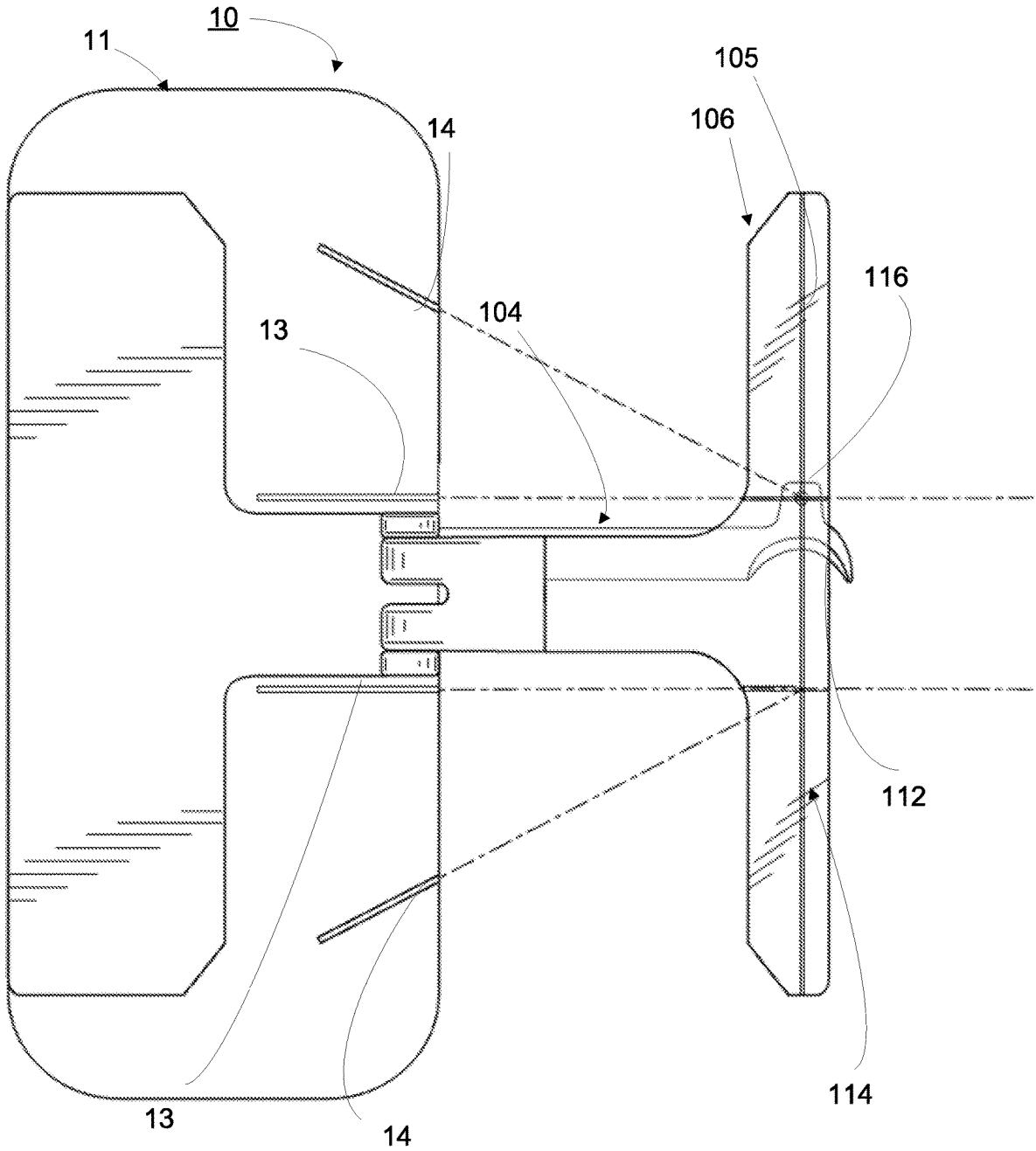
FIG. 17 is a top plan view of the alignment device shown in FIG. 16.
Figure 18:
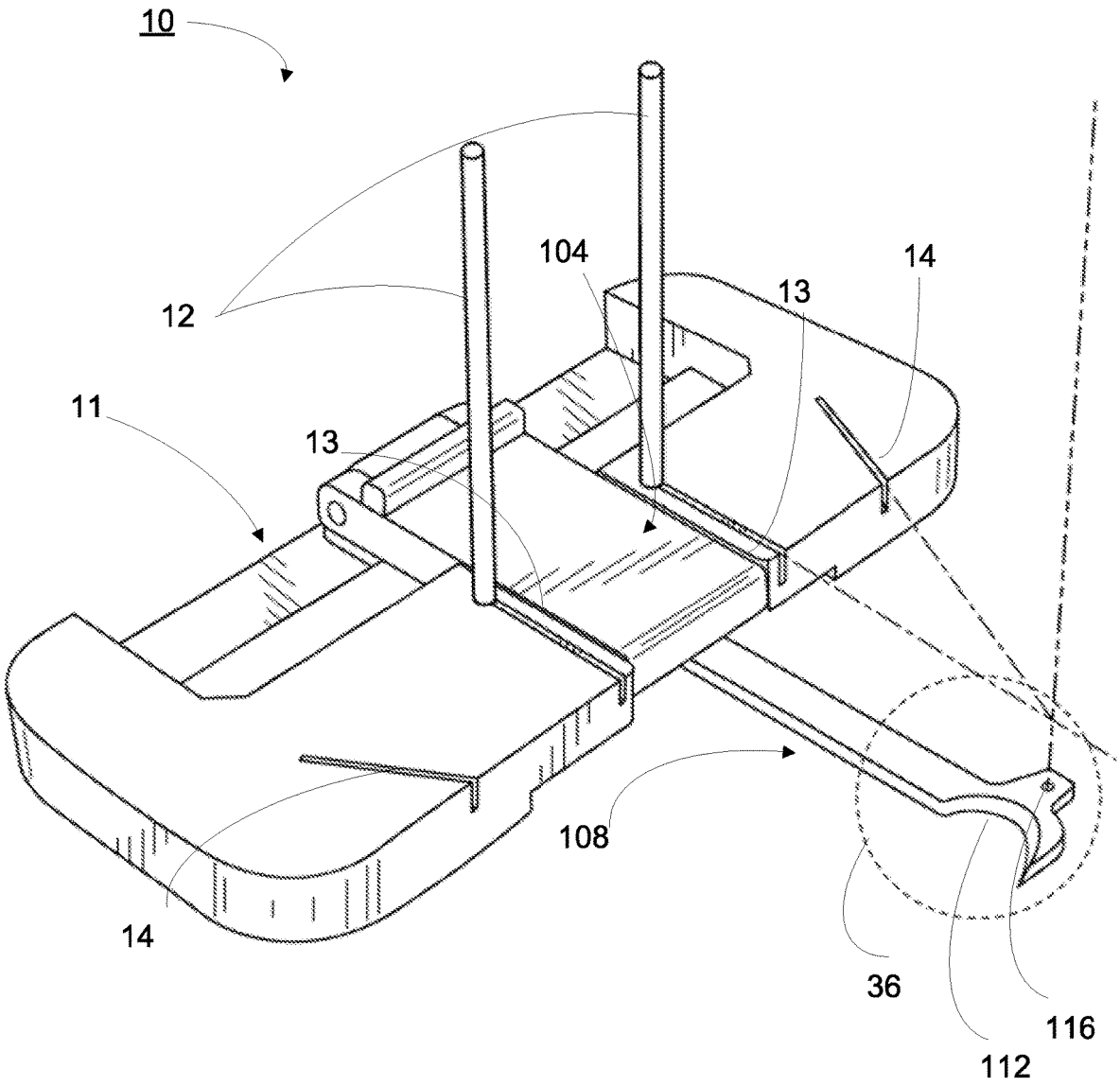
FIG. 18 is a perspective view of an alignment device according to a seventh embodiment of the invention wherein vertical alignment extension members are in their deployed state.
Figure 19:
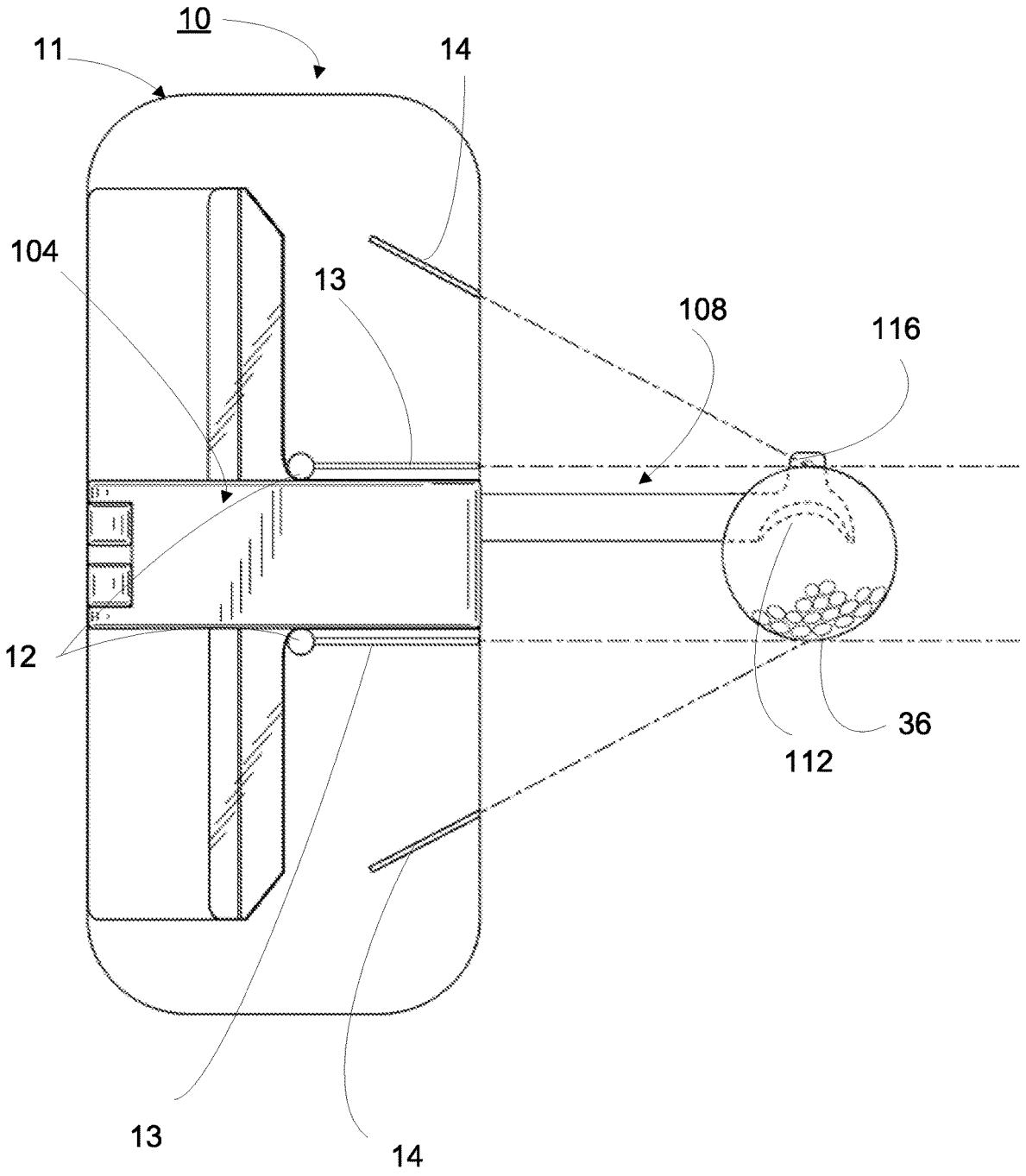
FIG. 19 is a top plan view of the alignment device shown in FIG. 18.

Referring now to FIGS. 16-19, the lateral alignment extension member 108 may be structured with an alignment feature 116, which may be a formed dimple, aperture, marking, or other visual indicator to be viewed by the golfer. As illustrated in FIGS. 16 and 17, the "crosshairs" of the alignment indicia 114 may be aligned with the alignment feature 116 to allow for the preferred line-of-sight eye positioning.

Figure 20:
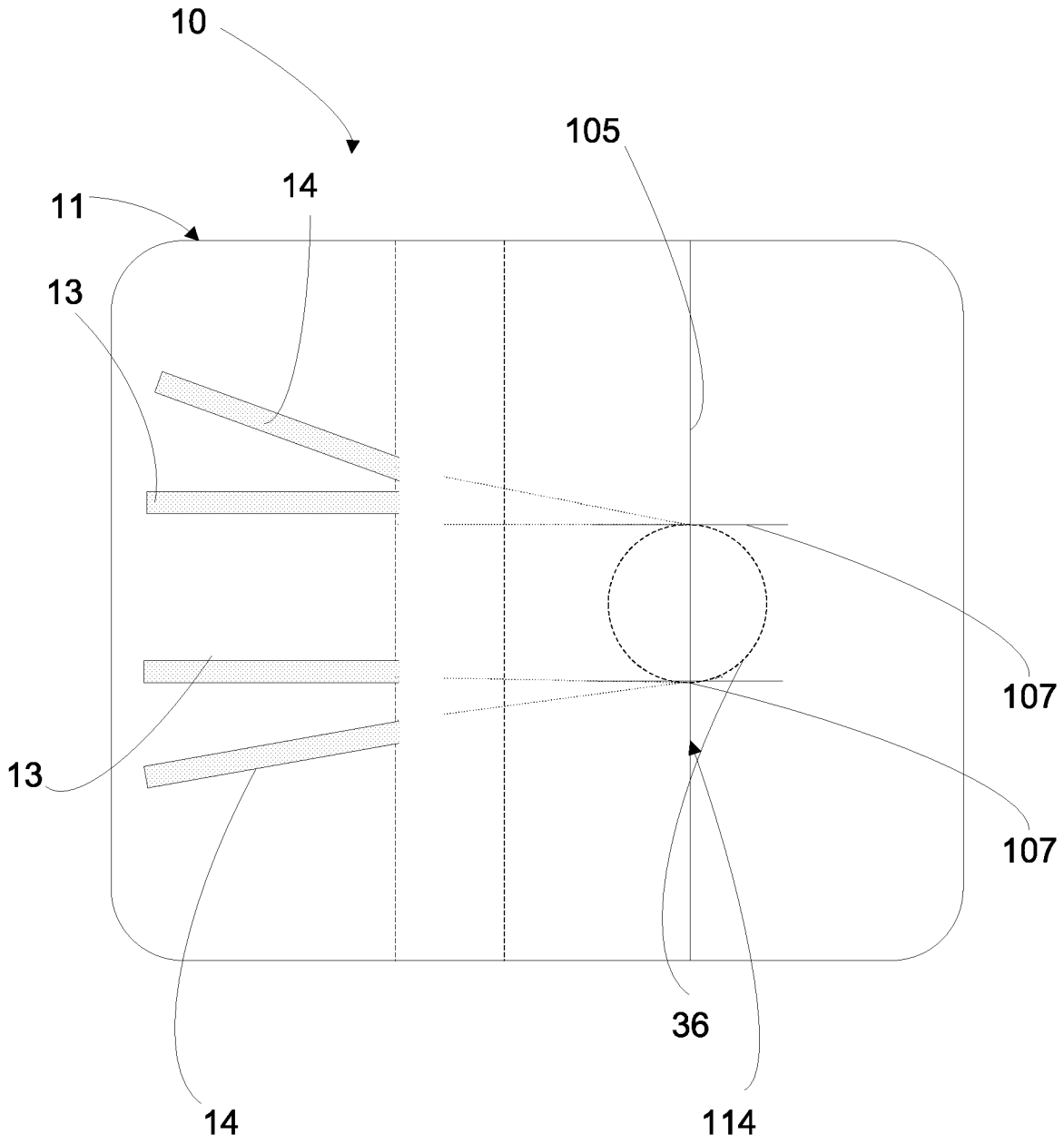
FIG. 20 is a top plan view of an alignment device according to an eight embodiment of the invention.
Figure 21:
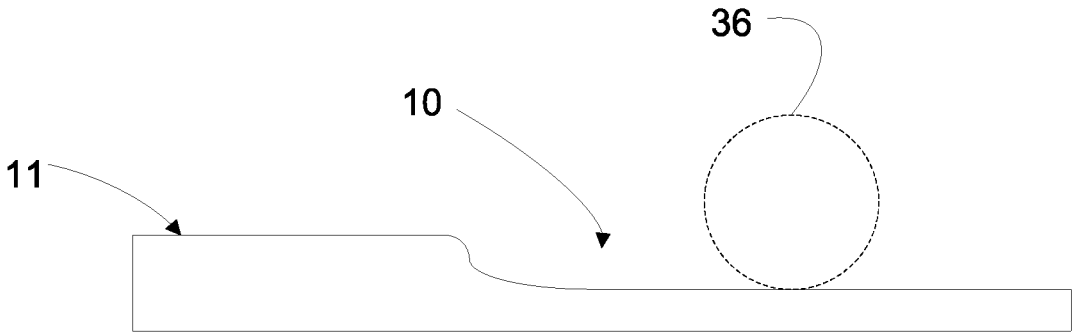
FIG. 21 is a side view of the alignment device shown in FIG. 20.

Referring now to FIGS. 20 and 21 the alignment device 10 may comprise a base 11 with alignment indicia 13, 14 and alignment indicia 114 such as to provide for a simple embodiment of the invention where he golf ball 36 may be positioned directly on the base 11. The base 11 may be of varying thickness, such that a thickness at the position of alignment indicia 13, 14 is thick relative the thickness at the position of the alignment indicia 114. Similar to other embodiments, alignment indicia 13, 14 may have corresponding alignment indicia 13, 14 in positions mirrored about the second axis of the base 11, such as to accommodate both left-handed and right-handed golfers.

In use, as the golfer practices putting with the alignment device 10 and encounters the misalignments described in this application, corrections can be made by reorienting the dominant eye so as to result in the preferred position. Use of the alignment device 10 permits a golfer to practice putting in a manner that permits association of putts missed to the left or right of the hole with various misalignments as described above and illustrated in the drawings. The base 11 permits the alignment device 10 to be aligned substantially parallel with the ground on which the base 11 rests. Over time, visual feedback and correction permit the golfer to putt during regular play without the alignment device by retaining the mental impression of the proper alignment, thereby increasing the probability of striking the ball in such a manner that the ball travels in the direction actually perceived by the golfer.

An improved golf alignment device is described above. Various details of the invention may be changed without departing from the scope of the invention. Furthermore, the foregoing description of embodiments of the invention and best mode for practicing the invention are provided for the purpose of illustration only and not for the purpose of limitation, the invention being defined by the claims.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. An alignment device for golf to be used as a practice aid for aligning a dominant eye of a user, a putter and a golf ball with a target line to a hole on a putting green, comprising:

a base comprising at least one alignment indicia;

at least one alignment extension extending from the base, wherein the at least one alignment indicia of the base and the at least one alignment extension are configured to align the dominant eye of the user, the putter and the golf ball with the target line to the hole on the putting green;

wherein the base comprises a first lateral surface and a second lateral surface, wherein the base comprises first and second lateral sides and first and second ends extending between the first lateral surface and the second lateral surface, wherein the base comprises a first axis extending from the first end to the second end, wherein the at least one alignment indicia of the base is located on the first lateral surface, wherein the at least one alignment extension comprises at least one vertical alignment extension member extending from the first lateral surface of the base, wherein the at least one vertical alignment extension member comprises a support member extending from the first lateral surface of the base and a lateral alignment extension member extending from the support member laterally; and wherein the support member is rotatably coupled to the first lateral surface of the base and wherein the axis of rotation of the support member relative to the base is parallel to the first axis such that the direction of rotation of the support member relative to the base is perpendicular to the first axis.

2. An alignment device according to claim 1, wherein the at least one alignment indicia on the base comprises at least one selected from the group consisting of a slot or line.

3. An alignment device according to claim 1, wherein the base comprises a second axis extending from the first lateral side to the second lateral side at the midway point of the first axis, and wherein the base comprises a first part and a second part demarcated by the second axis, and wherein the at least one alignment indicia on the base comprises at least one selected from the group consisting of a slot or line located on the first part having a first end point and a second end point, wherein the distance from first end of the base to the first end point is shorter than the distance from the first end of the base to the second end point.

4. An alignment device according to claim 1, wherein the base comprises a second axis extending from the first lateral side to the second lateral side at the midway point of the first axis, and wherein the base comprises a first part and a second part demarcated by the second axis, and wherein the at least one alignment indicia on the base comprises at least one selected from the group consisting of a slot or line located on the first part having a first end point and a second end point, wherein the distance from first end of the base to the first end point is the same as the distance from the first end of the base to the second end point.

5. An alignment device according to claim 1, wherein the second lateral surface of the base comprises a substantially planar surface and wherein the at least one alignment extension comprises a lateral alignment extension member extending from the base laterally in a plane that is the same as or is parallel to the planar surface defined by the second lateral surface of the base.

6. An alignment device according to claim 5, wherein the lateral alignment extension member comprises at least one alignment indicia.

7. An alignment device according to claim 6, wherein the at least one alignment indicia on the lateral alignment extension member comprises at least one selected from the group consisting of a slot or line.

8. An alignment device according to claim 5, wherein the lateral alignment extension member comprises an aperture.

9. An alignment device according to claim 1, wherein the at least one vertical alignment extension member comprises a straight elongate member.

10. An alignment device according to claim 1, wherein the second lateral surface of the base comprises a substantially planar surface and wherein the at least one vertical alignment extension member comprises a support member extending from the first lateral surface of the base and a lateral alignment extension member extending from the support member laterally in a plane that is substantially parallel to the planar surface defined by the second lateral surface of the base.

11. An alignment device according to claim 10, wherein the lateral alignment extension member is rotatably coupled to the support member.

12. An alignment device according to claim 10, wherein the first lateral surface of the base defines a recess structured to receive the support member and the lateral alignment extension member in a stored state.

13. An alignment device according to claim 10, wherein the lateral alignment extension member comprises at least one alignment indicia.

14. An alignment device according to claim 13, wherein the at least one alignment indicia on the lateral alignment extension member comprises at least one selected from the group consisting of a slot or line.

15. An alignment device for golf to be used as a practice aid for aligning a dominant eye of a user, a putter and a golf ball with a target line to a hole on a putting green, comprising:

a base comprising at least one alignment indicia;

at least one alignment extension extending from the base, wherein the at least one alignment indicia of the base and the at least one alignment extension are configured to align the dominant eye of the user, the putter and the golf ball with the target line to the hole on the putting green;

wherein the base comprises a first lateral surface and a second lateral surface, wherein the base comprises first and second lateral sides and first and second ends extending between the first lateral surface and the second lateral surface, wherein the at least one alignment indicia of the base is located on the first lateral surface, wherein the base comprises a first axis extending from the first end to the second end, wherein the at least one alignment extension comprises at least one vertical alignment extension member extending from the first lateral surface of the base, wherein the at least one vertical alignment extension member comprises a support member extending from the first lateral surface of the base and a lateral alignment extension member extending from the support member laterally; and wherein the lateral alignment extension member is rotatably coupled to the support member and wherein the axis of rotation of the lateral alignment extension member relative to the support member is parallel to the first axis such that the direction of rotation of the lateral alignment extension member relative to the support member is perpendicular to the first axis.

16. An alignment device according to claim 15, wherein the at least one alignment indicia on the base comprises at least one selected from the group consisting of a slot or line.

17. An alignment device according to claim 15, wherein the second lateral surface of the base comprises a substantially planar surface and wherein the at least one alignment extension comprises a lateral alignment extension member extending from the base laterally in a plane that is the same as or is parallel to the planar surface defined by the second lateral surface of the base.

18. An alignment device according to claim 17, wherein the lateral alignment extension member comprises at least one alignment indicia.

* * * * *